US007153639B2

(12) United States Patent
Tamaoki et al.

(10) Patent No.: US 7,153,639 B2
(45) Date of Patent: Dec. 26, 2006

(54) SILVER HALIDE COLOR PHOTOGRAPHIC LIGHTSENSITIVE MATERIAL

(75) Inventors: Hiroshi Tamaoki, Minami-Ashigara (JP); Yoichi Suga, Minami-Ashigara (JP); Yoshio Ishii, Minami-Ashigara (JP); Mitsuhiro Uchida, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 258 days.

(21) Appl. No.: 10/468,359

(22) PCT Filed: Dec. 5, 2002

(86) PCT No.: PCT/JP02/12797

§ 371 (c)(1),
(2), (4) Date: Aug. 19, 2003

(65) Prior Publication Data

US 2004/0161713 A1 Aug. 19, 2004

(30) Foreign Application Priority Data

Dec. 5, 2001 (JP) ..... 2001-371574

(51) Int. Cl.

| | |
|---|---|
| ***G03C 1/46*** | (2006.01) |
| ***G03C 1/76*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/506; 430/543; 430/567; 430/523; 430/449; 430/557; 430/553; 430/555; 430/501

(58) Field of Classification Search ..... 430/543, 430/506, 567, 523, 449, 557, 553, 555, 501
See application file for complete search history.

(56) References Cited

U.S. PATENT DOCUMENTS

| | | | | |
|---|---|---|---|---|
| 4,668,611 | A | 5/1987 | Nakamura | |
| 5,057,405 | A * | 10/1991 | Shiba et al. | 430/506 |
| 5,198,328 | A * | 3/1993 | Shiba et al. | 430/506 |
| 5,422,231 | A * | 6/1995 | Nozawa | 430/506 |
| 5,631,122 | A * | 5/1997 | Mihayashi et al. | 430/506 |
| 6,045,983 | A | 4/2000 | Buitano et al. | |

FOREIGN PATENT DOCUMENTS

| | | |
|---|---|---|
| JP | 3-113436 | 5/1991 |

OTHER PUBLICATIONS

DATA WPI Section Ch, Week 199126 Derwent Publication Ltd., London, GB; AN 1991-188089 XP002241865.

* cited by examiner

*Primary Examiner*—Geraldine Letscher
(74) *Attorney, Agent, or Firm*—Sughrue Mion, PLLC

(57) ABSTRACT

Disclosed is a silver halide color photographic lightsensitive material comprising a support and, superimposed thereon, a blue-sensitive layer unit, a green-sensitive layer unit and a red-sensitive layer unit, each of these layers comprising at least two silver halide emulsion layers with different photographic speeds, together with at least one antihalation layer, wherein couplers capable of color formation are contained in a total coating amount of 0.02 mmol/$m^2$ to 2 mmol/$m^2$.

15 Claims, 1 Drawing Sheet

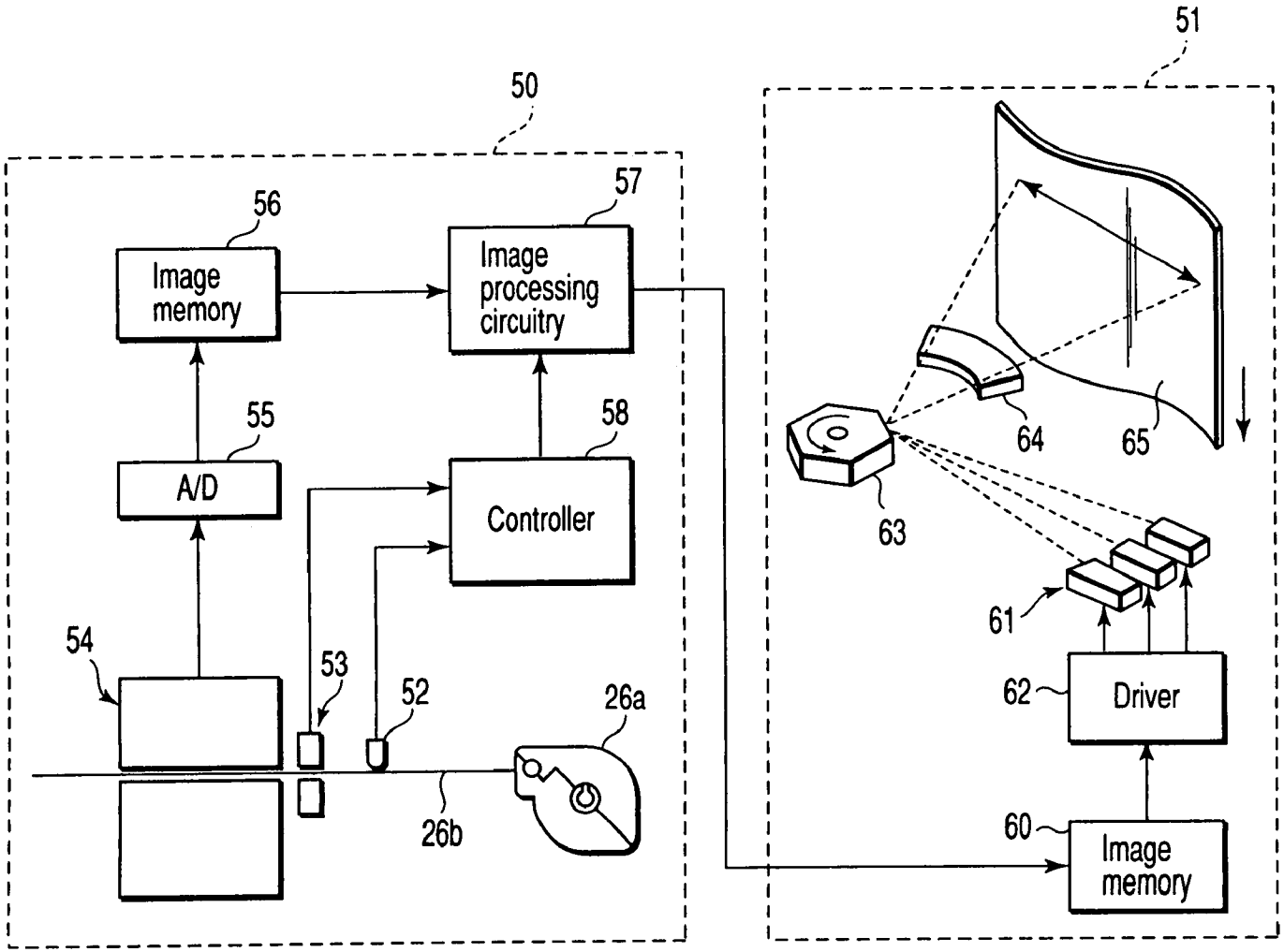
FIGURE

SILVER HALIDE COLOR PHOTOGRAPHIC LIGHTSENSITIVE MATERIAL

CROSS-REFERENCE TO RELATED APPLICATIONS

This application is a 35 USC 371 of PCT/JP02/12797 filed Dec. 5, 2002; the disclosure of which is incorporated herein by reference.

This application is based upon and claims the benefit of priority from the prior Japanese Patent Application No. 2001-371574, filed Dec. 5, 2001, the entire contents of which are incorporated herein by reference.

TECHNICAL FIELD

The present invention relates to a silver halide color photographic lightsensitive material which is excellent in processing stability and which has realized a replenishment reduction with respect to processing solutions.

BACKGROUND ART

Generally, the following means are known as providing a method of photographing a subject and recording the subject as a color image on a recording medium such as a recording paper.

The means most common on the current market comprises loading a camera with a silver halide color photographic lightsensitive material for photographing such as a color negative film, performing optical image information exposure (formation of latent image) and subjecting the silver halide color photographic lightsensitive material after exposure (after formation of latent image) to color development processing to thereby obtain an image. When a color negative film is used, the thus obtained negative image is directly subjected to surface exposure on a silver halide color photographic lightsensitive material for appreciation such as a color paper, or alternatively first optically read to obtain image information and then effecting exposure on a color paper on the basis of obtained image information. Thereafter, development processing is carried out to thereby obtain a color image of the subject.

In recent years, systems not requiring any development processing, such as a digital camera, have been developed. In rivalry therewith, it is desired to minimize the processing time for silver halide lightsensitive material.

Further, increased attention is being drawn to the problem of deterioration of global environment. In this respect, it is of importance to reduce the volume of wet processing solutions used.

Therefore, what is to be attained by the silver halide color photographic lightsensitive material for photographing resides in:

(1) shortening of the time to finish, and (2) reduction of the replenishment rate with respect to processing solutions, leading to reduction of not only maintenance but also waste solutions.

With respect to the item (1) above, for example, Jpn. Pat. Appln. KOKAI Publication No. (hereinafter referred to as JP-A-) 7-181649 is known as providing a lightsensitive material suitable for realization of rapid processing. However, the effect thereof is unsatisfactory when the current processing is performed.

The above means fail to shorten the time spent in drying step subsequent to development processing. Consequently, for attaining a substantial processing speed increase, further improvement has been demanded.

With respect to the item (2) above, all the steps, except the development processing step in which a lightsensitive material is first processed, suffer a dilution attributed to solution carry-over from the previous bath. This has occasionally caused lowering of the replenishment rate to be infeasible.

Various methods for lowering the replenishment rate have been disclosed. For example, JP-A-8-227134 describes the reduction of solution carry-over from previous bath by improvement to squeeze means, which, however, has not always been satisfactory.

DISCLOSURE OF INVENTION

It is an object of the present invention to provide a color negative lightsensitive material which is excellent in rapid processing suitability, paying attention to environment through the reduction of replenishment rate with respect to processing solutions.

It has been found that the object of the present invention can be attained by the following means.

The means include:

(1) A silver halide color photographic lightsensitive material comprising a support and, superimposed thereon, a blue-sensitive layer unit, a green-sensitive layer unit and a red-sensitive layer unit, each of these layers comprising at least two silver halide emulsion layers with different photographic speeds, together with at least one antihalation layer, wherein couplers capable of color formation are contained in a total coating amount of 0.02 mmol/$m^2$ to 2 mmol/$m^2$.

(2) The silver halide color photographic lightsensitive material according to item (1) above, wherein a yellow dye forming coupler is contained in a coating amount of 0.009 mmol/$m^2$ to 0.9 mmol/$m^2$, a magenta dye forming coupler in a coating amount of 0.004 mmol/$m^2$ to 0.4 mmol/$m^2$ and a cyan dye forming coupler in a coating amount of 0.007 mmol/$m^2$ to 0.7 mmol/$m^2$.

(3) The silver halide color photographic lightsensitive material according to item (1) or (2) above, wherein silver is contained in a total coating amount of 0.05 g/$m^2$ to 5.0 g/$m^2$.

(4) The silver halide color photographic lightsensitive material according to any of items (1) to (3) above, wherein at least one coupler represented by the general formula (I) or the general formula (II) is contained.

Formula (I)

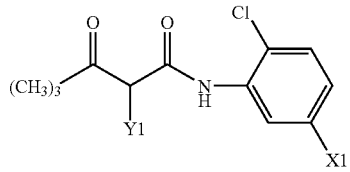

wherein X1 represents a —$CO_2C_{16}H_{33}$, a —$CO_2CH(C_4H_9)CO_2C_{12}H_{25}$ or a —$NHSO_2C_{16}H_{33}$; and Y1 represents a 5,5-dimethyloxazolidine-2,4-dion-3-yl group, a 1-benzyl-2-phenyltriazolidine-3,5-dion-4-yl group or a 4-(4-hydroxyphenylsulfonyl)phenoxy group.

Formula (II)

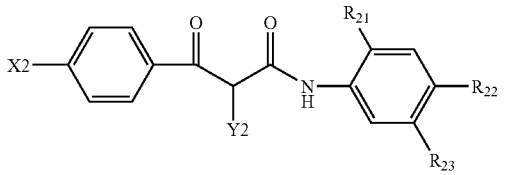

wherein X2 represents a hydrogen atom, a methoxy group or a —$OC_{16}H_{33}$; $R_{21}$ represents a chlorine atom, a methoxy group or a —$OC_{14}H_{29}$; $R_{22}$ represents a hydrogen atom or a —$SO_2N(CH_3)_2$; $R_{23}$ represents a hydrogen atom, a chlorine atom, a —$CO_2CH(CH_3)CO_2C_{12}H_{25}$ or a —$CO_2C_{12}H_{25}$; and Y2 represents a 1-benzylimidazoline-2,4-dion-3-yl group or a 2-(N-phenylcarbamoyl)imidazol-1-yl group.

(5) The silver halide color photographic lightsensitive material according to any of items (1) to (3) above, wherein a coupler represented by the general formula (III) is contained.

Formula (III)

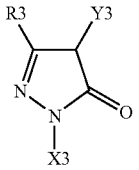

wherein X3 represents a 2,4,6-trichlorophenyl group, a 2,3,4,5,6-pentachlorophenyl group or a 2,5-dichlorophenyl group; R3 represents a group selected from among the following groups:

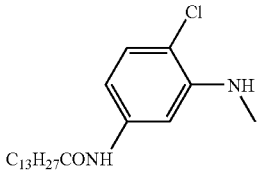

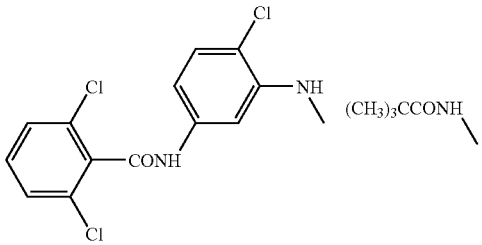

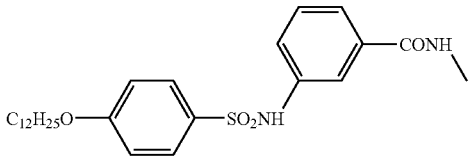

-continued

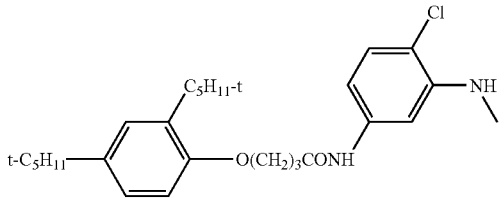

and Y3 represents a hydrogen atom or a group selected from among the following groups:

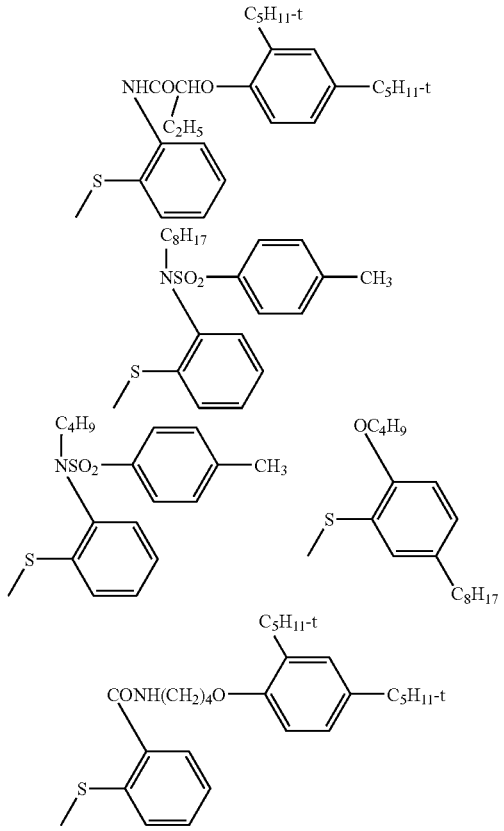

(6) The silver halide color photographic lightsensitive material according to any of items (1) to (3) above, wherein at least one coupler represented by the general formula (IV) or the general formula (V) is contained.

Formula (IV)

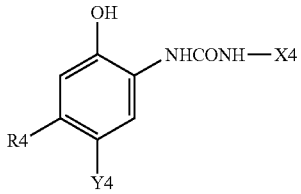

wherein X4 represents a 4-cyanophenyl group, a 3,4-dicyanophenyl group, a 4-chloro-3-cyanophenyl group, a 3-chloro-4-cyanophenyl group or a 4-fluorophenyl group;

Y4 represents a hydrogen atom, a 4-methoxyphenoxy group or a methoxycarbonylmethoxy group; and R4 represents a group selected from among the following groups:

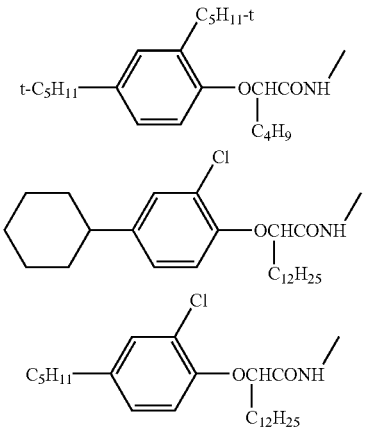

Formula (V)

wherein X5 represents a 2-octyloxy-5-octylphenyl group, a 4-(2,4-di-t-amylphenoxy)butyl group or a 2-methyl-5-undecylcarbonylphenyl group; and Y5 represents a chlorine atom or a group selected from among the following groups:

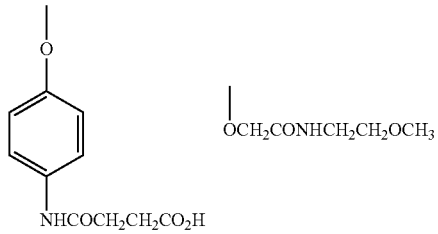

(7) A package of silver halide color photographic lightsensitive material, comprising a light-shielding container and, accommodated in rolled form therein, a silver halide color photographic lightsensitive material according to any of items (1) to (6) above.

(8) The package of silver halide color photographic lightsensitive material according to item (7) above, wherein the silver halide color photographic lightsensitive material is one exposed in advance so as to have information relating thereto.

(9) The package of silver halide color photographic lightsensitive material according to item (8) above, wherein the information relating to the silver halide color photographic lightsensitive material accommodated in the package of silver halide color photographic lightsensitive material is provided in electrically or optically readable form.

(10) A lens-equipped film unit comprising photographing means including a camera lens, a shutter equipment of fixed speed, a diaphragm and an electronic flash equipment, the lens-equipped film unit loaded in advance with an unexposed photographic film, wherein the photographic film is provided by the package of silver halide color photographic lightsensitive material according to item (7) or (8) above.

(11) A method of forming an image, comprising, by means of a scanner capable of converting an image information to an electrical signal in at least three wavelength regions, converting an image information of the silver halide color photographic lightsensitive material according to any of items (1) to (10) above to a digital color image signal and carrying out gradation conversion and color conversion processings suitable for the photographic lightsensitive material, thereby outputting an RGB image constituted of red image signal (R), green image signal (G) and blue image signal (B).

BRIEF DESCRIPTION OF DRAWINGS

The single FIGURE is a block diagram showing the construction of a digital printer.

BEST MODE FOR CARRYING OUT THE INVENTION

The ISO speed of the color negative photographic lightsensitive material according to the present invention is preferably 320 or greater, more preferably 640 or greater, and most preferably 1280 or greater.

The silver halide color photographic lightsensitive material of the present invention is characterized in that couplers capable of color formation are contained in a total coating amount of 0.02 mmol/m$^2$ to 2 mmol/m$^2$. It is preferred that in the silver halide color photographic lightsensitive material a yellow dye forming coupler be contained in a coating amount of 0.009 mmol/m$^2$ to 0.9 mmol/m$^2$, a magenta dye forming coupler in a coating amount of 0.004 mmol/m$^2$ to 0.4 mmol/m$^2$ and a cyan dye forming coupler in a coating amount of 0.007 mmol/m$^2$ to 0.7 mmol/m$^2$.

In the present invention, it is preferred that at least one of the dye forming couplers represented by the following general formulae (I) to (V) be contained in the lightsensitive material. The general formulae (I) and (II) represent yellow dye forming couplers. The general formula (III) represents magenta dye forming couplers. The general formulae (IV) and (V) represent cyan dye forming couplers.

Formula (I)

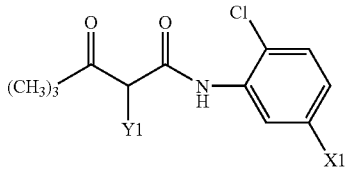

wherein, X1 represents a hydrogen atom or a substituent, and Y1 represents a hydrogen atom or a coupling split-off group. When X1 represents a substituent, the substituent can be, for example, any of halogen atoms, alkyl groups (including a cycloalkyl group and a bicycloalkyl group), alkenyl groups (including a cycloalkenyl group and a bicycloalkenyl group), alkynyl groups, aryl groups, heterocyclic groups, a cyano group, a hydroxyl group, a nitro group, a carboxyl group, alkoxy groups, aryloxy groups, a silyloxy group, heterocyclic oxy groups, acyloxy groups, a carbamoyloxy group, alkoxycarbonyloxy groups, aryloxycarbonyloxy groups, amino groups (including an alkylamino group and an anilino group), acylamino groups, an aminocarbonylamino group, alkoxycarbonylamino groups, aryloxycarbonylamino groups, a sulfamoylamino group, alkyl- and arylsulfonylamino groups, a mercapto group, alkylthio groups, arylthio groups, heterocyclic thio groups, a sulfamoyl group, a sulfo group, alkyl- and arylsulfinyl groups, alkyl- and arylsulfonyl groups, acyl groups, aryloxycarbonyl groups, alkoxycarbonyl groups, a carbamoyl group, aryl and heterocyclic azo groups, an imido group, a phosphino group, a phosphinyl group, a phosphinyloxy group, a phosphinylamino group and a silyl group.

The above substituent may further have a substituent. This further substituent can be any of those groups listed above.

When Y1 represents a coupling split-off group, the coupling split-off group can be, for example, any of a group split off at a nitrogen atom, a group split off at an oxygen atom, a group split off at a sulfur atom and a halogen atom (e.g., chlorine atom or bromine atom).

As the group split off at a nitrogen atom, there can be mentioned, for example, a heterocyclic group (preferably a 5 to 7-membered, substituted or unsubstituted, saturated or unsaturated, aromatic (in the present invention meaning those having 4n+2 cyclic conjugated electrons) or nonaromatic, monocyclic or condensed-ring heterocyclic group; more preferably a 5 or 6-membered heterocyclic group whose ring forming atoms are selected from among carbon, oxygen, nitrogen and sulfur atoms, the 5 or 6-membered heterocyclic group having at least one heteroatom selected from among nitrogen, oxygen and sulfur atoms, such as a succinimide, a maleinimide, a phthalimide, a diglycolimide, a pyrrole, a pyrazole, an imidazole, a 1,2,4-triazole, a tetrazole, an indole, a benzopyrazole, a benzimidazole, a benzotriazole, an imidazoline-2,4-dione, an oxazolidine-2,4-dione, a thiazolidin-2-one, a benzimidazolin-2-one, a benzoxazolin-2-one, a benzothiazolin-2-one, a 2-pyrrolin-5-one, a 2-imidazolin-5-one, an indoline-2,3-dione, a 2,6-dioxypurineparabanic acid, a 1,2,4-triazolidine-3,5-dione, a 2-pyridone, a 4-pyridone, a 2-pyrimidone, a 6-pyridazone, a 2-pyrazone or a 2-amino-1,3,4-thiazolidin-4-one group), a carbonamido group (for example, acetamido or trifluoroacetamido), a sulfonamido group (for example, methanesulfonamido or benzenesulfonamido), an arylazo group (for example, phenylazo or naphthylazo) or a carbamoylamino group (for example, N-methylcarbamoylazo).

As the group split off at an oxygen atom, there can be mentioned, for example, an aryloxy group (for example, phenoxy or 1-naphthoxy), a heterocyclic oxy group (for example, pyridyloxy or pyrazolyloxy), an acyloxy group (for example, acetoxy or benzoyloxy), an alkoxy group (for example, methoxy or dodecyloxy), a carbamoyloxy group (for example, N,N-diethylcarbamoyloxy or morpholinocarbamoyloxy), an aryloxycarbonyloxy group (for example, phenoxycarbonyloxy), an alkoxycarbonyloxy group (for example, methoxycarbonyloxy or ethoxycarbonyloxy), an alkylsulfonyloxy group (for example, ethanesulfonyloxy) or an arylsulfonyloxy group (for example, benzenesulfonyloxy or toluenesulfonyloxy).

An aryloxy group, an acyloxy group and a heterocyclic oxy group are preferred among the groups split off at an oxygen atom.

As the group split off at a sulfur atom, there can be mentioned, for example, an arylthio group (for example, phenylthio or naphthylthio), a heterocyclic thio group (for example, tetrazolylthio, 1,3,4-thiadiazolylthio, 1,3,4-oxazolylthio or benzimidazolylthio), an alkylthio group (for example, methylthio, octylthio or hexadecylthio), an alkylsulfinyl group (for example, methanesulfinyl), an arylsulfinyl group (for example, benzenesulfinyl), an arylsulfonyl group (for example, benzenesulfonyl) or an alkylsulfonyl group (for example, methanesulfonyl).

An arylthio group and a heterocyclic group are preferred, and a heterocyclic group is most preferred, among the groups split off at a sulfur atom.

Y1 may have a substituent. As the substituent for Y1, there can be mentioned, for example, those listed above as the substituent of X1.

Preferably, X1 represents a $—CO_2C_{16}H_{33}$, a $—CO_2CH(C_4H_9)CO_2C_{12}H_{25}$ or a $—NHSO_2C_{16}H_{33}$. Preferably, Y1 represents a 5,5-dimethyloxazolidine-2,4-dion-3-yl group, a 1-benzyl-2-phenyltriazolidine-3,5-dion-4-yl group or a 4-(4-hydroxyphenylsulfonyl)phenoxy group.

Formula (II)

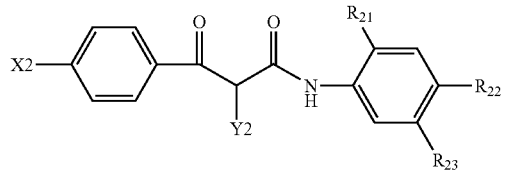

wherein each of X2, $R_{21}$, $R_{22}$ and $R_{23}$ represents a hydrogen atom or a substituent. This substituent can be, for example, any of those listed above as examples of the substituents of X1. Y2 represents a hydrogen atom or a coupling split-off group. When Y2 represents a coupling split-off group, the coupling split-off group can be, for example, any of those listed above as examples of the coupling split-off groups of Y1. Preferably, X2 represents a hydrogen atom, a methoxy group or a $—OC_{16}H_{33}$. Preferably, $R_{21}$ represents a chlorine atom, a methoxy group or a $—OC_{14}H_{29}$. Preferably, $R_{22}$ represents a hydrogen atom or a $—SO_2N(CH_3)_2$. Preferably, $R_{23}$ represents a hydrogen atom, a chlorine atom, a $—CO_2CH(CH_3)CO_2C_{12}H_{25}$ or a $—CO_2C_{12}H_{25}$. Preferably, Y2 represents a 1-benzylimidazoline-2,4-dion-3-yl group or a 2-(N-phenylcarbamoyl)imidazol-1-yl group.

Formula (III)

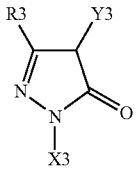

wherein each of X3 and R3 represents a hydrogen atom or a substituent. This substituent can be, for example, any of those listed above as examples of the substituents of X1. Y3 represents a hydrogen atom or a coupling split-off group. When Y3 represents a coupling split-off group, the coupling split-off group can be, for example, any of those listed above as examples of the coupling split-off groups of Y1. Preferably, X3 represents a 2,4,6-trichlorophenyl group, a 2,3,4,5,6-pentachlorophenyl group or a 2,5-dichlorophenyl group. Preferably, R3 represents a group selected from among the following groups:

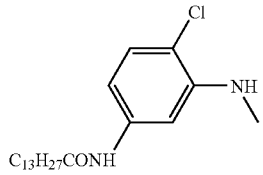

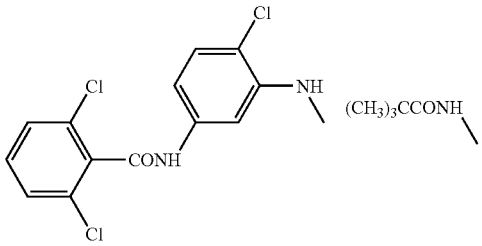

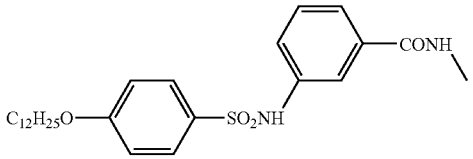

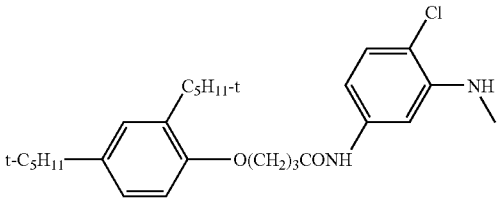

Preferably, Y3 represents a hydrogen atom or a group selected from among the following groups:

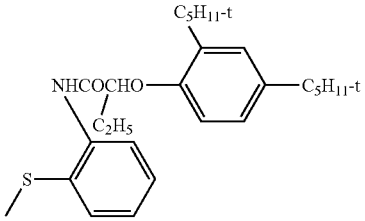

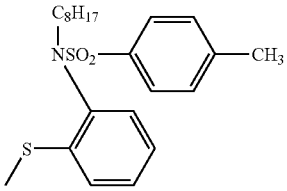

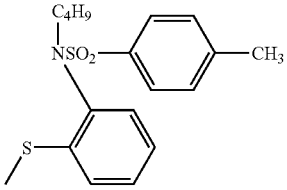

-continued

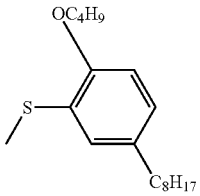

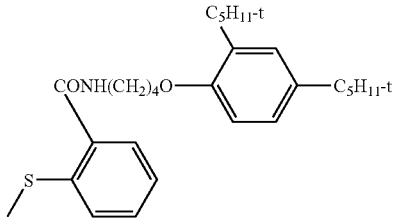

Formula (IV)

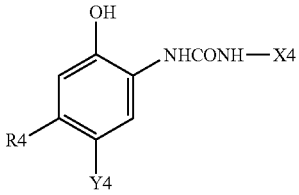

wherein each of X4 and R4 represents a hydrogen atom or a substituent. This substituent can be, for example, any of those listed above as examples of the substituents of X1. Y4 represents a hydrogen atom or a coupling split-off group. When Y4 represents a coupling split-off group, the coupling split-off group can be, for example, any of those listed above as examples of the coupling split-off groups of Y1. Preferably, X4 represents a 4-cyanophenyl group, a 3.4-dicyanophenyl group, a 4-chloro-3-cyanophenyl group, a 3-chloro-4-cyanophenyl group or a 4-fluorophenyl group. Preferably, Y4 represents a hydrogen atom, a 4-methoxyphenoxy group or a methoxycarbonylmethoxy group. Preferably, R4 represents a group selected from among the following groups:

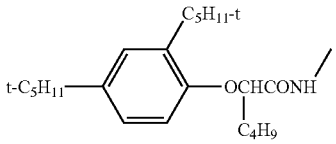

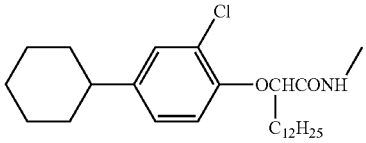

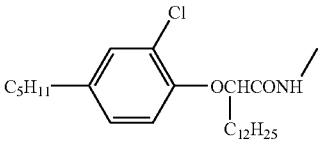

-continued

Formula (V)

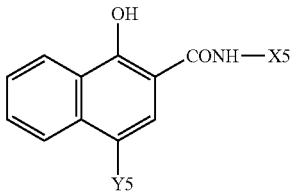

wherein X5 represents a hydrogen atom or a substituent. This substituent can be, for example, any of those listed above as examples of the substituents of X1. Y5 represents a hydrogen atom or a coupling split-off group. When Y5 represents a coupling split-off group, the coupling split-off group can be, for example, any of those listed above as examples of the coupling split-off groups of Y1. Preferably, X5 represents a 2-octyloxy-5-octylphenyl group, a 4-(2,4-di-t-amylphenoxy)butyl group or a 2-methyl-5-undecylcarbonylphenyl group. Preferably, Y5 represents a chlorine atom or a group selected from among the following groups:

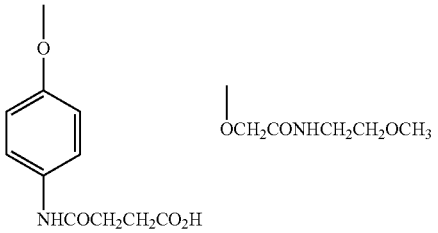

In the lightsensitive material of the present invention, it is preferred that the total coating amount of silver be 0.05 g/m$^2$ to 5.0 g/m$^2$.

It is preferred to utilize an interlayer inhibitory effect as means for improving a color reproduction. It is especially preferred that the weight-average sensitivity wavelength of spectral sensitivity distribution of green-sensitive silver halide emulsion layer ($\lambda_G$) satisfy the relationship: 520 nm<$\lambda^G$≦580 nm; that the weight-average wavelength of spectral sensitivity distribution of magnitude of interlayer effect exerted on red-sensitive silver halide emulsion layer from other silver halide emulsion layers at 500 nm to 600 nm ($\lambda_{-R}$) satisfy the relationship: 500 nm<$\lambda_{-R}$<560 nm; and that $\lambda_G$-$\lambda_{-R}$ be at least 5 nm, preferably at least 10 nm.

For imparting the above interlayer effect to the red-sensitive layer in a specified wavelength region, it is preferred to dispose a separate interlayer effect donor layer containing silver halide grains, which has been subjected to given spectral sensitization.

For realizing the spectral sensitivity desired in the present invention, the interlayer sensitivity wavelength of the interlayer effect donor layer is set for 510 to 540 nm.

The weight-average wavelength of wavelength distribution of magnitude of interlayer effect exerted on red-sensitive silver halide emulsion layer from other silver halide emulsion layers at 500 nm to 600 nm ($\lambda_{-R}$) can be determined by the method described in JP-A-61-34541.

Compounds which react with developing agent oxidation products obtained by development to thereby release a development inhibitor or a precursor thereof are used as the material for exerting the interlayer effect. For example, use can be made of DIR (development inhibitor releasing) couplers, DIR hydroquinone and couplers capable of releasing DIR hydroquinone or a precursor thereof. When the development inhibitor has a high diffusivity, the development inhibiting effect can be exerted irrespective of the position of the donor layer in the interlayer multilayer structure. However, there also occurs a development inhibiting effect in nonintended directions. Therefore, for correcting this, it is preferred that the donor layer be colored (for example, coloring is made into the same color as that of the layer on which undesirable development inhibitor effect is exerted). For causing the lightsensitive material of the present invention to obtain desirable spectral sensitivity, it is preferred that the donor layer capable of exerting the interlayer effect realize magenta color formation.

Although, for example, the size and configuration of silver halide grains for use in the layer capable of exerting the interlayer effect on the red-sensitive layer are not particularly limited, it is preferred to use so-called tabular grains of high aspect ratio, a monodisperse emulsion having uniform grain size, or silver iodobromide grains having an iodine layer structure. Further, for extending an exposure latitude, it is preferred to mix a plurality of emulsions whose grain sizes are different from each other.

Although the donor layer capable of exerting the interlayer effect on the red-sensitive layer may be provided by coating at any position on the support, it is preferred that the donor layer be provided by is coating at a position which is closer to the support than the blue-sensitive layer and which is more remote from the support than the red-sensitive layer. It is further preferred that the donor layer be positioned closer to the support than any yellow filter layer.

It is more preferred that the donor layer capable of exerting the interlayer effect on the red-sensitive layer be provided at a position which is closer to the support than the green-sensitive layer and which is more remote from the support than the red-sensitive layer. The donor layer is most preferably arranged at a position adjacent to a side of the green-sensitive layer close to the support. The terminology "adjacent" used herein means that an intermediate layer or any other matter is not interposed therebetween.

The layer capable of exerting the interlayer effect on the red-sensitive layer may be composed of a plurality of layers. These layers may be positioned so that they are adjacent to each other or are apart from each other.

In the present invention, the weight-average wavelength $\lambda_R$ of red-sensitive layer is defined by the mathematical formula (1).

Mathematical formula (1):

$$\lambda_R = \frac{\int_{550}^{700} \lambda S(\lambda)\, d\lambda}{\int_{550}^{700} S(\lambda)\, d\lambda}$$

wherein $S_R(\lambda)$ represents a spectral sensitivity distribution curve of red-sensitive layer. The $S_R$ at specified wavelength $\lambda$ is expressed as the inverse number of exposure quantity at which the cyan density becomes fog+0.5 at the time of exposure of specified wavelength.

The weight-average wavelength $\lambda_R$ of red-sensitive layer is in the range of 595 to 625 nm, preferably 600 to 620 nm.

The process from reading images of the lightsensitive material after development processing, via conducting image processing, to outputting on an output material will be described below. With respect to the image sensor unit for use in reading of images of the lightsensitive material after processing, a photoelectric element is used as the sensor. It is preferred to use a CCD array as the photoelectric element. CCD sensor of area type is preferably used as the CCD array. It is preferred that the image sensor unit include A/D conversion means, correction means capable of correction of CCD array and conversion means capable of logarithmic conversion of image signals, for color image signals detected by the CCD array. The image sensor unit is preferably so constructed that a prescanning in which film image is read with coarse sweeping spacing to thereby quickly obtain information on an outline of entire image is performed first prior to obtaining image signals of high resolution, followed by a fine scanning in which high-resolution reading is carried out.

With respect to the color image data captured by the above scanning, it is preferred that further image processing portion be had thereby. The particulars of such image processing preferably comprehend gradation change, sharpness intensification, granular inhibition, color correction, dodging processing, etc. Further, it is more preferred to sequentially display results of such image processing on a monitor to thereby enhance user's convenience.

The lightsensitive material of the present invention may have a gradation which is different from those of conventional color negative films. When it is intended to carry out image processing of the lightsensitive material having such a gradation, it is preferred to possess means for informing an image processor of the characteristic of the lightsensitive material, the image processor having a gradation table exclusively used for the lightsensitive material in advance, and to, when the image processing of the lightsensitive material is performed, carry out gradation conversion processing in accordance with the gradation table. No matter what gradation the lightsensitive material has, this method enables gradation conversion to image data of optimum gradation.

The digital image data having been subjected to image processing are outputted to various output means, thereby enabling obtaining color images. A method of writing data on an output material by the use of laser beams or LED radiation is preferably employed. Most preferably, a color paper is used as the output material.

FIGURE shows one form of digital printer processor whereby a print photograph is prepared from a photographic film (hereinafter referred to as "digital printer").

This digital printer can be divided mainly into input unit 50 and output unit 51. The input unit 50 includes magnetic head 52 capable of reading data of magnetic data trucks of photographic film 26*b*, photosensor 53 capable of optically reading, for example, side-printed bar codes, scanner 54 capable of reading images from each photographing frame of the photographic film 26*b*, A/D converter 55, image memory 56, image processing circuitry 57, transport means (not shown) capable of transporting developed photographic film 26*b* from cartridge 26*a* toward the scanner 54 and controller 58 capable of controlling these.

While the photographic film 26*b* is transported, the magnetic head 52 reads film information, etc. from each magnetic data truck of the photographic film 26*b*. Results of this reading are fed to the controller 58. Further, while the photographic film 26*b* is transported, the photosensor 53 reads revealed bar codes. Results of reading of the photosensor 53 are also fed to the controller 58. The results of reading of the magnetic head 52 and the photosensor 53 are decrypted by the controller 58 and used to control the image processing.

The scanner 54 includes a film carrier, an illuminator capable of illuminating each photographing frame set on the film carrier, a CCD capable of reading images of each photographing frame and a lens capable of focusing images of each photographing frame on the CCD. The scanner 54, every time the photographic film 26*b* is fed as much as one frame, causes the CCD to carry out separation of images of each photographing frame into three colors, namely, red, green and blue, photometry and image sensing, and transmits thus obtained photoelectric signals to the A/D converter 55.

The A/D converter 55 performs a digital conversion of the photoelectric signal of each color, so that the images sensed by the CCD are converted to red, green and blue image data. The three-color image data are written in the image memory 56. The image processing circuitry 57, every time image data amounting to one frame are written in the image memory 56, reads the same and carries out given image processing thereof under the control of the controller 58.

At this image processing, not only common image processing for preparation of conventional print photographs by digital image processing but also gradation correction based on the characteristic curves of photographic film 26*b* is carried out for the photographic film 26*b* detected from film information read by the magnetic head 52. The data of the characteristic curves providing the basis of gradation correction are written and registered in advance on, for example, EEPROM built in the image processing circuitry 57.

The output unit 51 includes image memory 60 on which processed image data from the image processing circuitry 57 are written, laser unit 61 capable of outputting red, blue and green laser beams, driver 62 capable of controlling the output of the laser unit 61 on the basis of the processed image data of the image memory 60, customary polygon mirror 63, Fθ lens 64 and transport means (not shown) capable of transporting lengthy color printing paper 65.

While the color printing paper 65 is transported by the output unit 51 in the longitudinal direction, the color printing paper 65 is exposed, through color images having been processed by means of the image processing circuitry 57, by not only main scanning of laser beams by the polygon mirror 63 rotated at a high speed but also subscanning by transportation of the color printing paper 65. The exposed color printing paper 65, after development processing, is cut apart into individual images, thereby providing print photographs.

The emulsion of the present invention relates to an emulsion of tabular grains of silver iodobromide, silver bromide or silver chloroiodobromide.

With respect to the tabular silver halide grains (hereinafter also simply referred to as "tabular grains"), the terminology "aspect ratio" means the ratio of diameter to thickness of silver halides. That is, it is a quotient of the diameter divided by the thickness of each individual silver halide grain. The terminology "diameter" used herein refers to the diameter of a circle having an area equal to the projected area of grain as obtained when observing silver halide grains through a microscope or an electron microscope.

The color negative photographic lightsensitive material of the present invention comprises a support and, superimposed thereon, at least one antihalation layer, at least one red-sensitive silver halide emulsion layer, at least one green-sensitive silver halide emulsion layer and at least one blue-sensitive silver halide emulsion layer. Each of the silver halide emulsion layers consists of a plurality of silver halide emulsion layers differing from each other in photographic speed, which plurality of silver halide emulsion layers include at least one emulsion layer of the highest photographic speed which contains tabular silver halide grains in a proportion of 50% or more based on the total projected area of silver halide grains contained in the layer. The average aspect ratio thereof is preferably 8 or greater, more preferably 10 or greater, and most preferably 12 or greater.

In this specification, the average aspect ratio is the average value of the aspect ratios of all tabular grains in an emulsion.

One example of an aspect ratio measurement method is to take a transmission electron micrograph by a replica method and obtain the equivalent-circle diameter and thickness of each individual grain. In this method, the thickness is calculated from the length of the shadow of a replica.

The shape of a tabular grain in the present invention is usually a hexagon. This hexagonal shape means that the shape of the principal planes of a tabular grain is a hexagon and the adjacent edge ratio (maximum edge length/minimum edge length) of the grain is 2 or less. This adjacent edge ratio is preferably 1.6 or less, and more preferably, 1.2 or less. The lower limit is, of course, 1.0. Especially in high-aspect-ratio grains, triangular tabular grains increase in amount in tabular grains. Triangular tabular grains appear when Ostwald ripening excessively progresses. To obtain substantially hexagonal tabular grains, the time of this ripening is preferably made as short as possible. To this end, it is necessary to manage to increase the ratio of tabular grains by nucleation. As described in Jpn. Pat. Appln. KOKAI Publication No. (hereinafter referred to as JP-A-) 63-11928 by Saito, the disclosure of which is incorporated herein by reference, to increase the probability of generation of hexagonal tabular grains when silver ions and bromide ions are added to a reaction solution by the double-jet method, one or both of the aqueous silver ion solution and the aqueous bromide ion solution preferably contain gelatin.

Hexagonal tabular grains contained in a light-sensitive material of the present invention are formed by nucleation, Ostwald ripening, and growth steps. In any of these steps, it is important to suppress the spread of the grain size distribution. Since the spread of the size distribution produced in any of the above steps cannot be narrowed in the subsequent steps, caution should be exercised so as not to spread the size distribution in the first nucleation process. An important factor in the nucleation process is the relationship between the nucleation time, during which silver ions and bromide ions are added to a reaction solution by the double-jet method to form a precipitation, and the temperature of the reaction solution. JP-A-63-92942 by Saito, the disclosure of which is incorporated herein by reference, describes that the temperature of the reaction solution during nucleation is preferably 20 to 45° C. in order to improve the monodispersibility. Also, JP-A-2-222940 by Zola et al., the disclosure of which is incorporated herein by reference, describes that the temperature of nucleation is preferably 60° C. or less.

To obtain high-aspect-ratio, monodisperse tabular grains, gelatin is sometimes added during grain formation. As this gelatin, chemically modified gelatin described in JP-A's-10-148897 and 11-143002, the disclosures of which are incorporated herein by reference, is preferably used. This chemically modified gelatin is characterized in that two or more carboxyl groups are introduced when an amino group in the gelatin is chemically modified. Although the use of trimellitated gelatin is preferred, succinated gelatin is also favorably used. This gelatin is added preferably before the growth step, and more preferably, immediately after nucleation. The addition amount is preferably 60% or more, more preferably, 80% or more, and particularly preferably, 90% or more with respect to the weight of all dispersing media in grain formation.

A tabular grain emulsion consists of silver iodobromide or silver bromochloroiodide. Although the emulsion can also contain silver chloride, the content of this silver chloride is preferably 8 mol % or less, more preferably, 3 mol % or less, and most preferably, 0 mol %. The content of silver iodide is preferably 20 mol % or less, since the variation coefficient of the distribution of grain sizes in a tabular grain emulsion is preferably 30% or less. Reducing the silver iodide content facilitates decreasing the variation coefficient of the distribution of grain sizes of a tabular grain emulsion. In particular, the variation coefficient of the distribution of grain sizes of a tabular grain emulsion is preferably 20% or less, and the silver iodide content is preferably 10 mol % or less.

A tabular grain emulsion used in the present invention preferably has a silver iodide distribution structure inside a grain. This silver iodide distribution structure can be a double structure, a triple structure, a quadruple structure, or a structure of higher order.

In the present invention, tabular grains have dislocation lines. Dislocation lines in tabular grains can be observed by a direct method performed using a transmission electron microscope at a low temperature, as described in, e.g., J. F. Hamilton, Phot. Sci. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 μm). From photographs of grains obtained by the above method, it is possible to obtain the positions and the number of dislocations in each grain viewed in a direction perpendicular to the principal planes of the grain.

The average number of dislocation lines is preferably 10 or more, and more preferably, 20 or more per grain. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains. Several hundreds of dislocation lines are sometimes found.

Dislocation lines can be introduced to, e.g., a portion near the peripheral region of a tabular grain. In this case, dislocations are substantially perpendicular to the peripheral region and produced from a position x % of the length between the center and the edge (peripheral region) of a tabular grain to the peripheral region. The value of x is preferably 10 to less than 100, more preferably, 30 to less than 99, and most preferably, 50 to less than 98. Although the shape obtained by connecting the start positions of the dislocations is almost similar to the shape of the grain, this shape is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

A tabular grain can have dislocation lines either almost uniformly across the whole peripheral region or at a particular position of the peripheral region. That is, in the case of a hexagonal tabular silver halide grain, dislocation lines can be limited to either portions near the six corners or only a portion near one of the six corners. In contrast, it is also possible to limit dislocation lines to only portions near the edges except for the portions near the six corners.

Dislocation lines can also be formed across a region containing the centers of two principal planes of a tabular grain. When dislocation lines are formed across the entire region of the principal planes, the direction of the dislocation lines is sometimes crystallographically, approximately a (211) direction with respect to a direction perpendicular to the principal planes. In some cases, however, the direction is a (110) direction or random. The lengths of the individual dislocation lines are also random; the dislocation lines are sometimes observed as short lines on the principal planes and sometimes observed as long lines reaching the edges (peripheral region). Although dislocation lines are sometimes straight, they are often zigzagged. In many cases, dislocation lines cross each other.

As described above, the position of dislocation lines can be either limited on the peripheral region or the principal planes or a local position on at least one of them. That is, dislocation lines can be present on both the peripheral region and the principal planes.

Introducing dislocation lines to a tabular grain can be achieved by forming a specific silver iodide rich phase inside the grain. This silver iodide rich phase can include a discontinuous silver iodide rich region. More specifically, after a substrate grain is prepared, the silver iodide rich phase is formed and covered with a layer having a silver iodide content lower than that of the silver iodide rich phase. The silver iodide content of the substrate tabular grain is lower than that of the silver iodide rich phase, and is preferably 0 to 20 mol %, and more preferably, 0 to 15 mol %.

In this specification, the silver iodide rich phase inside a grain is a silver halide solid solution containing silver iodide. This silver halide is preferably silver iodide, silver iodobromide, or silver bromochloroiodide, and more preferably, silver iodide or silver iodobromide (the silver iodide content with respect to a silver halide contained in this silver iodide rich phase is 10 to 40 mol %). To cause this silver iodide rich phase inside a grain (to be referred to as an internal silver iodide rich phase hereinafter) to selectively exist on the edge, the corner, or the surface of a substrate grain, it is desirable to control the formation conditions of the substrate grain, the formation conditions of the internal silver iodide rich phase, and the formation conditions of a phase covering the outside of the internal silver iodide rich phase. Important factors as the formation conditions of a substrate grain are the pAg (the logarithm of the reciprocal of a silver ion concentration), the presence/absence, type, and amount of a silver halide solvent, and the temperature. By controlling the pAg to preferably 8.5 or less, more preferably, 8 or less during the growth of substrate grains, the internal silver iodide rich phase can be made to selectively exist in portions near the corners or on the surface of the substrate grain, when this silver iodide rich phase is formed later.

On the other hand, by controlling the pAg to preferably 8.5 or more, more preferably, 9 or more during the growth of substrate grains, the internal silver iodide rich phase can be made to exist on the edges of the substrate grain. The threshold value of the pAg rises and falls depending on the temperature and the presence/absence, type, and amount of a silver halide solvent. When thiocyanate is used as the silver halide solvent, this threshold value of the pAg shifts to higher values. The value of the pAg at the end of the growth of substrate grains is particularly important, among other pAg values during the growth. On the other hand, even if the pAg during the growth does not meet the above value, the position of the internal silver iodide rich phase can be controlled by performing ripening by controlling the pAg to the above proper value after the growth of substrate grains. In this case, ammonia, an amine compound, a thiourea derivative, or thiocyanate salt can be effectively used as the silver halide solvent. The internal silver iodide rich phase can be formed by a so-called conversion method.

This method includes a method which, at a certain point during grain formation, adds halogen ion smaller in solubility for salt for forming silver ion than halogen ion that forms grains or portions near the surfaces of grains at that point. In the present invention, the amount of halogen ion having a smaller solubility to be added preferably takes a certain value (related to a halogen composition) with respect to the surface area of grains at that point. For example, at a given point during grain formation, it is preferable to add a certain amount or more of KI with respect to the surface area of silver halide grains at that point. More specifically, it is preferable to add $8.2\times10^{-5}$ mol/$m^2$ or more of iodide salt.

A more preferable method of forming the internal silver iodide rich phase is to add an aqueous silver salt solution simultaneously with addition of an aqueous silver halide solution containing iodide salt.

As an example, an aqueous $AgNO_3$ solution is added simultaneously with addition of an aqueous KI solution by the double-jet method. In this case, the addition start timings and the addition end timings of the aqueous KI solution and the aqueous $AgNO_3$ solution can be shifted from each other. The addition molar ratio of the aqueous $AgNO_3$ solution to the aqueous KI solution is preferably 0.1 or more, more preferably, 0.5 or more, and most preferably, 1 or more. The total addition molar quantity of the aqueous $AgNO_3$ solution can exit in a silver excess region with respect to halogen ion in the system and iodine ion added. During the addition of the aqueous silver halide solution containing iodine ion and the addition of the aqueous silver salt solution by the double-jet method, the pAg preferably decreases with the addition time by the double-jet. The pAg before the addition is preferably 6.5 to 13, and more preferably, 7.0 to 11. The pAg at the end of the addition is most preferably 6.5 to 10.0.

In carrying out the above method, the solubility of a silver halide in the mixing system is preferably as low as possible. Therefore, the temperature of the mixing system at which the silver iodide rich phase is formed is preferably 30° C. to 80° C., and more preferably, 30° C. to 70° C.

The formation of the internal silver iodide rich phase is most preferably performed by adding fine-grain silver iodide, fine-grain silver iodobromide, fine-grain silver chloroiodide, or fine-grain silver bromochloroiodide. The addition of fine-grain silver iodide is particularly preferred. These fine grains normally have a grain size of 0.01 to 0.1 μm, but those having a grain size of 0.01 μm or less or 0.1 μm or more can also be used. Methods of preparing these fine silver halide grains are described in JP-A's-1-183417, 2-44335, 1-183644, 1-183645, 2-43534, and 2-43535, the disclosures of which are incorporated herein by reference. The internal silver iodide rich phase can be formed by adding and ripening these fine silver halide grains. In dissolving the fine grains by ripening, the silver halide solvent described above can also be used. These fine grains added need not immediately, completely dissolve to disappear but need only disappear by dissolution when the final grains are completed.

The internal silver iodide rich phase is located in a region of, when measuring from the center of, e.g., a hexagon formed in a plane by projecting a grain thereon, preferably 5 to less than 100 mol %, more preferably, 20 to less than 95 mol %, and most preferably, 50 to less than 90 mol % with respect to the total silver amount of the grain. The amount of a silver halide which forms the internal silver iodide rich phase is, as a silver amount, preferably 50 mol % or less, and more preferably, 20 mol % or less of the total silver amount of a grain. These values of amounts of the silver iodide rich phase are not those obtained by measuring the halogen composition of the final grain by using various analytical methods but formulated values in the producing of a silver halide emulsion. The internal silver iodide rich phase often disappears from the final grain owing to, e.g., recrystallization, and so all silver amounts described above are related to their formulated values.

It is, therefore, readily possible to observe dislocation lines in the final grains by the above method, but the internal silver iodide rich phase introduced to introduce dislocation lines cannot be observed as a definite phase in many cases because the silver iodide composition in the boundary continuously changes. The halogen compositions in each portion of a grain can be checked by combining X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain).

The silver iodide content of an outer phase covering the internal silver iodide rich phase is lower than that of the silver iodide rich phase, and is preferably 0 to 30 mol %, more preferably, 0 to 20 mol %, and most preferably, 0 to 10 mol % with respect to a silver halide amount contained in the outer phase.

Although the temperature and the pAg, at which the outer phase covering the internal silver iodide rich phase is formed, can take arbitrary values, the temperature is preferably 30° C. to 80° C., and most preferably, 35° C. to 70° C., and the pAg is preferably 6.5 to 11.5. The use of the silver halide solvents described above is sometimes preferable, and the most preferable silver halide solvent is thiocyanate salt.

Another method of introducing dislocation lines to tabular grains is to use an iodide ion releasing agent as described in JP-A-6-11782, the disclosure of which is incorporated herein by reference. This method is also preferably used.

Dislocation lines can also be introduced by appropriately combining this dislocation line introducing method with the above-mentioned dislocation line introducing method.

The variation coefficient of the inter-grain iodide distribution of silver halide grains used in the present invention is preferably 20% or less, more preferably, 15% or less, and most preferably, 10% or less. If the variation coefficient of the iodide content distribution of each individual silver halide is larger than 20%, no high contrast can be obtained, and a reduction of the sensitivity upon application of a pressure increases.

Any known method can be used as a method of producing silver halide grains used in the present invention and having a narrow inter-grain iodide distribution. Examples are a method of adding fine grains as disclosed in JP-A-1-183417 and a method which uses an iodide ion releasing agent as disclosed in JP-A-2-68538, the disclosures of which are incorporated herein by reference. These methods can be used alone or in combination.

The variation coefficient of the inter-grain iodide distribution of silver halide grains of the present invention is preferably 20% or less. The most preferred method of monodispersing the inter-grain iodide distribution is a method described in JP-A-3-213845, the disclosure of which is incorporated herein by reference. That is, fine silver halide grains containing 95 mol % or more of silver iodide are formed by mixing an aqueous solution of a water-soluble silver salt and an aqueous solution of a water-soluble halide (containing 95 mol % or more of iodide ions) in a mixer placed outside a reaction vessel, and supplied to the reaction vessel immediately after the formation. In this manner, a monodisperse inter-grain iodide distribution can be achieved. The reaction vessel is a vessel which causes nucleation and/or crystal growth of tabular silver halide grains.

As described in JP-A-3-213845, the disclosure of which is incorporated herein by reference, the following three technologies can be used as a method of adding the silver halide grains prepared in the mixer and as a preparing means used in the method.

(1) After being formed in the mixer, the fine grains are immediately added to the reaction vessel.

(2) Strong and efficient stirring is performed in the mixer.

(3) An aqueous protective colloid solution is poured into the mixer.

The protective colloid used in method (3) above can be singly poured into the mixer or can be poured into the mixer after being contained in an aqueous halogen salt solution or aqueous silver nitrate solution. The concentration of the protective colloid is 1 mass % or more, preferably 2 to 5 mass %. Examples of a polymer compound having a protective colloid function with respect to silver halide grains used in the present invention are a polyacrylamide polymer, an amino polymer, a polymer having a thioether group, polyvinyl alcohol, an acrylic acid polymer, a polymer having hydroxyquinoline, cellulose, starch, acetal, polyvinylpyrrolidone, and a ternary polymer. The use of low-molecular-weight gelatin is preferred. The weight-average molecular weight of this low-molecular-weight gelatin is preferably 30,000 or less, and more preferably, 10,000 or less.

When fine silver halide grains are to be prepared, the grain formation temperature is preferably 35° C. or less, and particularly preferably, 25° C. or less. The temperature of the reaction vessel to which fine silver halide grains are added is 5° C. or more, preferably 60° C. or more, and more preferably, 70° C. or more.

The grain size of a fine silver halide used in the present invention can be directly confirmed by a transmission electron microscope by placing the grain on a mesh. The size of fine grains of the present invention is preferably 0.3 μm or less, more preferably, 0.1 μm or less, and most preferably, 0.01 μm or less. This fine silver halide can be added simultaneously with another halogen ion or silver ion or can be added alone. The mixing amount of the fine silver halide grains is 0.005 to 20 mol %, preferably 0.01 to 10 mol % with respect to a total silver halide.

The silver iodide content of each grain can be measured by analyzing the composition of the grain by using an X-ray microanalyzer. The variation coefficient of an inter-grain iodide distribution is a value defined by (standard deviation/average silver iodide content)×100=variation coefficient (%)

by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., European Patent 147,868. A silver iodide content Yi [mol %] and an equivalent-sphere diameter Xi [μm] of each grain sometimes have a correlation and sometimes do not. However, Yi and Xi desirably have no correlation. The halogen composition structure of a tabular grain of the present invention can be checked by combining, e.g., X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain). When the silver iodide content is measured in the present invention, the grain surface is a region about 5 nm deep from the surface, and the grain interior is a region except for the surface. The halogen composition of this grain surface can usually be measured by the ESCA method.

In the present invention, regular-crystal grains such as cubic, octahedral, and tetradecahedral grains and irregular twinned-crystal grains can be used in addition to aforementioned tabular grains.

Silver halide emulsions of the present invention are preferably subjected to selenium sensitization or gold sensitization.

As selenium sensitizers usable in the present invention, selenium compounds disclosed in conventionally known patents can be used. Usually, a labile selenium compound and/or a non-labile selenium compound is used by adding it to an emulsion and stirring the emulsion at a high temperature, preferably 40° C. or more for a predetermined period of time. As non-labile selenium compounds, it is preferable to use compounds described in, e.g., Jpn. Pat. Appln. KOKOKU Publication No. (hereinafter referred to as JP-B-) 44-15748, JP-B-43-13489, and JP-A's-4-25832 and 4-109240, the disclosures of which are incorporated herein by reference.

Practical examples of a labile selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro-2,6-dimethoxybenzoyl)selenide), selenophosphates, phosphineselenides, and colloidal metal selenium.

Although preferred examples of a labile selenium compound are described above, the present invention is not limited to these examples. It is generally agreed by those skilled in the art that the structure of a labile selenium compound used as a sensitizer for a photographic emulsion is not so important as long as selenium is labile, and that the organic part of a molecule of a selenium sensitizer has no important role except the role of carrying selenium and keeping it in a labile state in an emulsion. In the present invention, therefore, labile selenium compounds in this extensive concept are advantageously used.

Examples of a non-labile selenium compound usable in the present invention are compounds described in JP-B's-46-4553, 52-34491, and 52-34492, the disclosures of which are incorporated herein by reference. Practical examples of a non-labile selenium compound are selenious acid, potassium selenocyanide, selenazoles, quaternary ammonium salts of selenazoles, diarylselenide, diaryldiselenide, dialkylselenide, dialkyldiselenide, 2-selenazolidinedione, 2-selenoxazolidinethione, and derivatives of these compounds.

These selenium sensitizers are dissolved in water, an organic solvent such as methanol or ethanol, or a solvent mixture of such organic solvents, and the resultant solution is added during chemical sensitization, preferably before the start of chemical sensitization. A selenium sensitizer to be used is not limited to one type, but two or more types of the selenium sensitizers described above can be used together. Combining a labile selenium compound and a non-labile selenium compound is preferred.

The addition amount of selenium sensitizers usable in the present invention changes in accordance with the activity of each selenium sensitizer used, the type or grain size of a silver halide, and the temperature and time of ripening. The addition amount, however, is preferably $2\times10^{-6}$ to $5\times10^{-6}$ mol per mol of a silver halide. When selenium sensitizers are used, the temperature of chemical sensitization is preferably 40° C. to 80° C. The pAg and pH can take given values. For example, the effect of the present invention can be obtained in a wide pH range of 4 to 9.

Selenium sensitization can be achieved more effectively in the presence of a silver halide solvent.

Examples of a silver halide solvent usable in the present invention are (a) organic thioethers described in U.S. Pat. Nos. 3,271,157, 3,531,289, and 3,574,628, and JP-A's-54-1019 and 54-158917, the disclosures of which are incorporated herein by reference, (b) thiourea derivatives described in JP-A's-53-82408, 55-77737, and 55-2982, the disclosures of which are incorporated herein by reference, (c) a silver halide solvent having a thiocarbonyl group sandwiched between an oxygen or sulfur atom and a nitrogen atom, described in JP-A-53-144319, the disclosure of which is incorporated herein by reference, (d) imidazoles described in JP-A-54-100717, the disclosure of which is incorporated herein by reference, (e) sulfite, and (f) thiocyanate.

Most preferred examples of a silver halide solvent are thiocyanate and tetramethylthiourea. Although the amount of a solvent to be used changes in accordance with its type, a preferred amount is $1\times10^{-4}$ to $1\times10^{-2}$ mol per mol of a silver halide.

A gold sensitizer for use in gold sensitization of the present invention can be any compound having an oxidation number of gold of +1 or +3, and it is possible to use gold compounds normally used as gold sensitizers. Representative examples are chloroaurate, potassium chloroaurate, auricrichloride, potassium auricthiocyanate, potassium iodoaurate, tetracyanoauric acid, ammonium aurothiocyanate, pyridyltrichloro gold, gold sulfide, and gold selenide. Although the addition amount of gold sensitizers changes in accordance with various conditions, the amount is preferably $1\times10^{-7}$ to $5\times10^{-5}$ mol per mol of a silver halide.

Emulsions of the present invention are preferably subjected to sulfur sensitization during chemical sensitization. This sulfur sensitization is commonly performed by adding sulfur sensitizers and stirring the emulsion for a predetermined time at a high temperature, preferably 40° C. or more.

Sulfur sensitizers known to those skilled in the art can be used in sulfur sensitization. Examples are thiosulfate, allylthiocarbamidothiourea, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016, the disclosures of which are incorporated herein by reference. The addition amount of sulfur sensitizers need only be large enough to effectively increase the sensitivity of an emulsion.

This amount changes over a wide range in accordance with various conditions, such as the pH, the temperature, and the size of silver halide grains. However, the amount is preferably $1\times10^{-7}$ to $5\times10^{-5}$ mol per mol of a silver halide.

Silver halide emulsions of the present invention can also be subjected to reduction sensitization during grain formation, after grain formation and before or during chemical sensitization, or after chemical sensitization.

Reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be used together.

The method of adding reduction sensitizers is preferred in that the level of reduction sensitization can be finely adjusted.

Known examples of reduction sensitizers are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferred compounds as reduction sensitizers are stannous chloride, thiourea dioxide, dimethylamineborane, and ascorbic acid and its derivative. Although the addition amount of reduction sensitizers must be so selected as to meet the emulsion producing conditions, a preferable amount is $10^{-7}$ to $10^{-3}$ mol per mol of a silver halide.

Reduction sensitizers are dissolved in water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

It is preferable to use an oxidizer for silver during the process of producing emulsions of the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones.

It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

Photographic emulsions of the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679,4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

When a plurality of sensitizing dyes are to be added, these sensitizing dyes can be separately added with predetermined pauses between them or added mixedly, or a portion of one sensitizing dye is previously added and the rest is added together with the other sensitizing dyes. That is, it is possible to select an optimum method in accordance with the types of the chosen sensitizing dyes and with the desired spectral sensitivity.

The addition amount of sensitizing dyes can be $4\times10^{-6}$ to $8\times10^{-3}$ mol per mol of a silver halide. However, for a more favorable silver halide grain size of 0.2 to 1.2 μm, an addition amount of about $5\times10^{-5}$ to $2\times10^{-3}$ mol is more effective.

The twin plane spacing of a silver halide grain of the present invention is preferably 0.017 μm or less, more preferably, 0.007 to 0.017 μm, and most preferably, 0.007 to 0.015 μm.

Fog occurring while a silver halide emulsion of the present invention is aged can be improved by adding and dissolving a previously prepared silver iodobromide emulsion during chemical sensitization. This silver iodobromide emulsion can be added at any timing during chemical sensitization. However, it is preferable to first add and dissolve the silver iodobromide emulsion and then add sensitizing dyes and chemical sensitizers in this order. The silver iodobromide emulsion used has an iodide content lower than the surface iodide content of a host grain, and is preferably a pure silver bromide emulsion. The size of this silver iodobromide emulsion is not limited as long as the emulsion can be completely dissolved. However, the equivalent-sphere diameter is preferably 0.1 μm or less, and more preferably, 0.05 μm or less. Although the addition amount of the silver iodobromide emulsion changes in accordance with a host grain used, the amount is basically preferably 0.005 to 5 mol %, and more preferably, 0.1 to 1 mol % per mol of silver.

The addition amount of each of hexacyanoiron (II) complex and hexacyanoruthenium complex (hereinafter also simply referred to as "metal complex") for use in the present invention is preferably in the range of $10^{-7}$ to $10^{-3}$ mol, more preferably $1.0\times10^{-5}$ to $5\times10^{-4}$ mol, per mol of silver halides.

Metal complexes used in the present invention can be added in any stage of the preparation of silver halide grains, i.e., before or after nucleation, growth, physical ripening, or chemical sensitization. Also, metal complexes can be divisionally added a plurality of times. However, 50% or more of the total content of metal complexes contained in a silver halide grain are preferably contained in a layer ½ or less as a silver amount from the outermost surface of the grain. A layer not containing metal complexes can also be formed on the outside, i.e., on the side away from a support, of the layer containing metal complexes herein mentioned.

These metal complexes are preferably contained by dissolving them in water or an appropriate solvent and directly adding the solution to a reaction solution during the formation of silver halide grains, or by forming silver halide grains by adding them to an aqueous silver salt solution, aqueous silver salt solution, or some other solution for forming the grains. Alternatively, these metal complexes are also favorably contained by adding and dissolving fine silver halide grains previously made to contain the metal complexes, and depositing these grains on other silver halide grains.

When these metal complexes are to be added, the hydrogen ion concentration in a reaction solution is such that the pH is preferably 1 to 10, and more preferably, 3 to 7.

In the present invention, the unit lightsensitive layer refers to a lightsensitive layer laminate consisting of a plurality of silver halide emulsion layers whose color sensitivities are substantially identical with each other but whose photographic speeds are different from each other. The lightsensitive layer unit is sensitive to blue, green or red light. Any of the samples of the present invention at least has a blue-sensitive layer unit, a green-sensitive layer unit and a red-sensitive layer unit.

In a multilayered silver halide color photographic light-sensitive material, light-sensitive layer units are generally arranged in the order of red-, green-, and blue-sensitive layers from a support. However, according to the intended use, this order of arrangement can be reversed, or light-sensitive layers sensitive to the same color can sandwich another light-sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit light-sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, the disclosures of which are incorporated herein by reference, layers can be arranged such that a low-speed emulsion layer is formed apart from a support and a high-speed emulsion layer is formed close to the support.

More specifically, layers can be arranged, from the one farthest from a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, the disclosure of which is incorporated herein by reference, layers can be arranged in the order of a blue-sensitive layer/GH/RH/GL/RL from the one farthest from a support. Furthermore, as described in JP-A's-56-25738 and 62-63936, the disclosures of which are incorporated herein by reference, layers can be arranged in the order of a blue-sensitive layer/GL/RL/GH/RH from the one farthest from a support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. Even when a layer structure is thus constituted by three layers having different sensitivities, these layers can be arranged, in a layer sensitive to one color, in the order of a medium-speed emulsion layer/high-speed emulsion layer/low-speed emulsion layer from the one farthest from a support as described in JP-A-59-202464, the disclosure of which is incorporated herein by reference.

In addition, the order of a high-speed emulsion layer/low-speed emulsion layer/medium-speed emulsion layer or low-speed emulsion layer/medium-speed emulsion layer/high-speed emulsion layer can be used.

Furthermore, the arrangement can be changed as described above even when four or more layers are formed.

In the antihalation layer, use may be made of black colloidal silver fine grains which are generally black (neutral color) and exhibits high light absorptivity, or an antihalation dye of decolorization type described in JP-A-2001-222090.

Solid disperse dyes described in JP-A-11-305396, the disclosure of which is incorporated herein by reference can be used in the present invention.

An emulsion used in a light-sensitive material of the present invention can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion is normally subjected to physical ripening, chemical sensitization, and spectral sensitization before being used. Additives for use in these steps are described in Research Disclosure (RD) Nos. 17643, 18716, and 307105, and the corresponding portions are summarized in a table to be presented later.

In a light-sensitive material of the present invention, it is possible to mix, in a single layer, two or more types of emulsions different in at least one of the characteristics, i.e., the grain size, grain size distribution, halogen composition, grain shape, and sensitivity, of a sensitive silver halide emulsion.

It is also preferable to apply surface-fogged silver halide grains described in U.S. Pat. No. 4,082,553, internally fogged silver halide grains described in U.S. Pat. No. 4,626,498 and JP-A-59-214852, and colloidal silver, to light-sensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852. A silver halide which forms the core of the internally fogged core/shell type silver halide grain can have a different halogen composition. As the internally fogged or surface-fogged silver halide, any of silver chloride, silver chlorobromide, silver iodobromide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol %, and silver chloride and/or silver iodide can be added if necessary. The fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 2 μm.

The fine-grain silver halide can be prepared following the same procedures as for a common light-sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

Although the several different additives described above are used in a light-sensitive material according to this technique, a variety of other additives can also be used in accordance with the intended use.

These additives are described in more detail in Research Disclosures Item 17643 (December, 1978), Item 18716 (November, 1979), and Item 308119 (December, 1989), the disclosures of which are incorporated herein by reference. The corresponding portions are summarized in a table below.

| | Additives | RD17643 | RD18716 |
|---|---|---|---|
| 1. | Chemical sensitizers | page 23 | page 648, right column |
| 2. | Sensitivity increasing agents | | page 648, right column |
| 3. | Spectral sensitizers, super sensitizers | pages 23–24 | page 648, right column to page 649, right column |
| 4. | Brighteners | page 24 | |
| 5. | Antifoggants and stabilizers | pages 24–25 | page 649, right column |
| 6. | Light absorbent, filter dye, ultra-violet absorbents | pages 25–26 | page 649, right column to page 650, left column |
| 7. | Stain preventing agents | page 25, right column | page 650, left to right columns |
| 8. | Dye image stabilizer | page 25 | |

-continued

| | Additives | RD17643 | RD18716 |
|---|---|---|---|
| 9. | Hardening agents | page 26 | page 651, left column |
| 10. | Binder | page 26 | page 651, left column |
| 11. | Plasticizers, lubricants | page 27 | page 650, right column |
| 12. | Coating aids, surface active agents | pages 26–27 | page 650, right column |
| 13. | Antistatic agents | page 27 | page 650, right column |
| 14. | Matting agent | | |

| | Additives | RD308119 |
|---|---|---|
| 1. | Chemical sensitizers | page 996 |
| 2. | Sensitivity increasing agents | |
| 3. | Spectral sensitizers, super sensitizers | page 996, right column to page 998, right column |
| 4. | Brighteners | page 998, right column |
| 5. | Antifoggants and stabilizers | page 998, right column to page 1,000, right column |
| 6. | Light absorbent, filter dye, ultra-violet absorbents | page 1,003, left column to page 1,003, right column |
| 7. | Stain preventing agents | page 1,002, right column |
| 8. | Dye image stabilizer | page 1,002, right column |
| 9. | Hardening agents | page 1,004, right column to page 1,005, left column |
| 10. | Binder | page 1,003, right column to page 1,004, right column |
| 11. | Plasticizers, lubricants | page 1,006, left to right columns |
| 12. | Coating aids, surface active agents | page 1,005, left column to page 1,006, left column |
| 13. | Antistatic agents | page 1,006, right column to page 1,007, left column |
| 14. | Matting agent | page 1,008, left column to page 1,009, left column |

Techniques such as a layer arrangement technique, silver halide emulsions, dye forming couplers, functional couplers such as DIR couplers, various additives, and development usable in emulsions of the present invention and light-sensitive materials using the emulsions are described in European Patent No. 0565096A1 (laid open in Oct. 13, 1993) and the patents cited in it, the disclosures of which are incorporated herein by reference. The individual items and the corresponding portions are enumerated below.

1. Layer arrangements: page 61, lines 23–35, page 61, line 41–page 62, line 14
2. Interlayers: page 61, lines 36–40
3. Interlayer effect donor layers: page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54–page 63, line 5
12. Physical ripening and chemical sensitization of emulsions page 63, lines 6–9
13. Use of emulsion mixtures: page 63, lines 10–13
14. Fogged emulsions: page 63, lines 14–31
15. Non-light-sensitive emulsions: page 63, lines 32–43
16. Silver coating amount: page 63, lines 49–50
17. Formaldehyde scavengers: page 64, lines 54–57
18. Mercapto-based antifoggants: page 65, lines 1–2
19. Agents releasing, e.g., fogging agent: page 65, lines 3–7
20. Dyes: page 65, lines 7–10
21. General color couplers: page 65, lines 11–13
22. Yellow, magenta, and cyan couplers: page 65, lines 14–25
23. Polymer couplers: page 65, lines 26–28
24. Diffusing dye forming couplers: page 65, lines 29–31
25. Colored couplers: page 65, lines 32–38
26. General functional couplers: page 65, lines 39–44
27. Bleaching accelerator release couplers: page 65, lines 45–48
28. Development accelerator release couplers: page 65, lines 49–53
29. Other DIR couplers: page 65, line 54–page 66, line 4
30. Coupler diffusing methods: page 66, lines 5–28
31. Antiseptic agents and mildewproofing agents: page 66, lines 29–33
32. Types of light-sensitive materials: page 66, lines 34–36
33. Light-sensitive layer film thickness and swell speed: page 66, line 40–page 67, line 1
34. Back layers: page 67, lines 3–8
35. General development processing: page 67, lines 9–11
36. Developers and developing agents: page 67, lines 12–30
37. Developer additives: page 67, lines 31–44
38. Reversal processing: page 67, lines 45–56
39. Processing solution aperture ratio: page 67, line 57-page 68, line 12
40. Development time: page 68, lines 13–15
41. Bleach-fix, bleaching, and fixing: page 68, line 16–page 69, line 31
42. Automatic processor: page 69, lines 32–40
43. Washing, rinsing, and stabilization: page 69, line 41–page 70, line 18
44. Replenishment and reuse of processing solutions: page 70, lines 19–23
45. Incorporation of developing agent into light-sensitive material: page 70, lines 24–33
46. Development temperature: page 70, lines 34–38
47. Application to film with lens: page 70, lines 39–41

It is also possible to preferably use a bleaching solution described in European Patent No. 602600, the disclosure of which is incorporated herein by reference, which contains 2-pyridinecarboxylic acid or 2,6-pyridinedicarboxylic acid, ferric salt such as ferric nitrate, and persulfate. When this bleaching solution is to be used, it is preferable to interpose a stop step and a washing step between the color development step and the bleaching step and to use organic acid such as acetic acid, succinic acid, or maleic acid as the stop bath. Furthermore, for the purposes of pH adjustment and bleaching fog, the bleaching solution preferably contains 0.1 to 2 mols/litter (litter will be referred to as "L" hereinafter) of organic acid such as acetic acid, succinic acid, maleic acid, glutaric acid, or adipic acid.

A magnetic recording layer preferably used in the present invention will be described below.

This magnetic recording layer is formed by coating the surface of a support with an aqueous or organic solvent-based coating solution which is prepared by dispersing magnetic grains in a binder.

As the magnetic grains used in the present invention, it is possible to use, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferred. The grain can take the shape of any of, e.g., a needle, rice grain, sphere, cube, and plate. The specific area is preferably 20 $m^2/g$ or more, and more preferably, 30 $m^2/g$ or more as SBET.

The saturation magnetization ($\sigma s$) of the ferromagnetic substance is preferably $3.0\times10^4$ to $3.0\times10^5$ A/m, and most preferably, $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032, the disclosure of which is incorporated herein by reference. A ferromagnetic grain whose surface is coated with an inorganic or organic substance described in JP-A-4-259911 or JP-A-5-81652, the disclosures of which are incorporated herein by reference, can also be used.

As a binder used in the magnetic grains, it is possible to use a thermoplastic resin, thermosetting resin, radiation-curing resin, reactive resin, acidic, alkaline, or biodegradable polymer, natural polymer (e.g., a cellulose derivative and sugar derivative), and their mixtures. These examples are described in JP-A-4-219569, the disclosure of which is incorporated herein by reference. The Tg of the resin is preferably −40° C. to 300° C., and its weight average molecular weight is preferably 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferred. Cellulosedi(tri)acetate is particularly preferred. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357, the disclosure of which is incorporated herein by reference.

As a method of dispersing the magnetic substance in the binder, as described in JP-A-6-35092, the disclosure of which is incorporated herein by reference, a kneader, pin type mill, and annular mill are preferably used singly or together. Dispersants described in JP-A-5-088283, the disclosure of which is incorporated herein by reference, and other known dispersants can be used. The thickness of the magnetic recording layer is 0.1 to 10 μm, preferably 0.2 to 5 μm, and more preferably, 0.3 to 3 μm. The weight ratio of the magnetic grains to the binder is preferably 0.5:100 to 60:100, and more preferably, 1:100 to 30:100. The coating amount of the magnetic grains is 0.005 to 3 $g/m^2$, preferably 0.01 to 2 $g/m^2$, and more preferably, 0.02 to 0.5 $g/m^2$. The transmission yellow density of the magnetic recording layer is preferably 0.01 to 0.50, more preferably, 0.03 to 0.20, and most preferably, 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436, the disclosure of which is incorporated herein by reference is preferred.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferred. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Light-sensitive materials having the magnetic recording layer are described in U.S. Pat. Nos. 5,336,589, 5,250,404, 5,229,259, 5,215,874, and EP 466,130, the disclosures of which are incorporated herein by reference.

A polyester support used in the present invention will be described below. Details of the polyester support and light-sensitive materials, processing, cartridges, and examples (to be described later) are described in Journal of Technical Disclosure No. 0.94-6023 (JIII; 1994, March 15), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred. Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg-20° C. to less than Tg. The heat treatment can be performed at a fixed temperature within this range or can be performed together with cooling. The heat treatment time is preferably 0.1 to 1500 hr, and more preferably, 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two of more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably $10^7$ Ω·cm or less, and more preferably, $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a light-sensitive material is preferably 5 to 500 mg/m$^2$, and particularly preferably, 10 to 350 mg/m$^2$. The ratio of a conductive crystalline oxide or its composite oxide to the binder is preferably 1/300 to 100/1, and more preferably, 1/100 to 100/5.

A light-sensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously-add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538, the disclosures of which are incorporated herein by reference. It is particularly preferable that the resistance be $10^{12}$ Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 cm$^3$ or less, preferably 25 cm$^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

A color photographic light-sensitive material of the present invention is also suitably used as a negative film for Advanced Photo System (to be referred to as APS hereinafter). Examples are the NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series (e.g., the EPION 300Z).

A color photosensitive film of the present invention is also suited as a film with lens such as the Fuji Film FUJICOLOR UTSURUNDESU SUPER SLIM or the UTSURUNDESU ACE 800.

A photographed film is printed through the following steps in a mini-lab system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably the Fuji Film SUPER FA8])

(6) Collation and shipment (the cartridge and the index print are collated by an ID number and shipped together with the prints)

As these systems, the Fuji Film MINI-LAB CHAMPION SUPER FA-298, FA-278, FA-258, FA-238 and the Fuji Film FRONTIER digital lab system are preferred. Examples of a film processor for the MINI-LAB CHAMPION are the FP922AL, FPS62B, FP562B,AL, FP362B, and FP362B,AL, and recommended processing chemicals are the FUJICOLOR JUST-IT CN-16L and CN-16Q. Examples of a printer processor are the PP3008AR, PP3008A, PP1828AR, PP1828A, PP1258AR, PP1258A, PP728AR, and PP728A, and a recommended processing chemicals are the FUJICOLOR JUST-IT-CP-47L and CP-40FAII. In the FRONTIER system, the SP-1000 scanner & image processor and the LP-1000P laser printer & paper processor or the LP-1000W laser printer are used. A detacher used in the detaching step and a reattacher used in the reattaching step are preferably the Fuji Film DT200 or DT100 and AT200 or AT100, respectively.

APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. _

Furthermore, image information recorded in a floppy disk, Zip disk, CR-R, or hard disk can be variously processed on a computer by using the Fuji Film PHOTO FACTORY application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

Examples of the present invention will be described below. However, the present invention is not limited to these examples.

EXAMPLE 1

Silver halide emulsions Em-A to Em-O were prepared by the following process.

(Preparation of Em-A)

1200 ml of an aqueous solution containing 1.0 g of a low-molecular-weight gelatin whose weight average molecular weight was 15,000 and 1.0 g of KBr was vigorously agitated while maintaining the temperature at 35° C. 30 ml of an aqueous solution containing 1.9 g of $AgNO_3$ and 30 ml of an aqueous solution containing 1.5 g of KBr and 0.7 g of a low-molecular-weight gelatin whose weight average molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 35 g of gelatin succinate was added. The pH was adjusted to 5.5. An aqueous solution of KBr and 150 ml of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8%, and the silver potential was maintained at −25 mV. Still further, an aqueous solution of KBr and 132 ml of an aqueous solution containing 35 g of $AgNO_3$ were added by the double jet method over a period of 7 min. The addition of the aqueous solution of KBr was regulated so that the potential at the completion of the addition was −20 mV. The temperature was regulated to 40° C., and 5.6 g, in terms of KI, of the following compound 1 was added. Further, 64 cc of a 0.8 M aqueous sodium sulfite solution was added. Still further, an aqueous solution of NaOH was added to thereby increase the pH to 9.0, and held undisturbed for 4 min so that iodide ions were rapidly formed. The pH was returned to 5.5 and the temperature to 55° C., and 1 mg of sodium benzenethiosulfonate was added. Further, 13 g of lime-processed gelatin having a calcium concentration of 1 ppm was added. After the completion of the addition, an aqueous solution of KBr and 250 ml of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

Compound 1

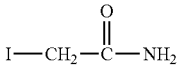

The calcium, magnesium and strontium contents of the thus obtained emulsion were measured by ICP emission spectrochemical analysis. The contents thereof were 15, 2 and 1 ppm, respectively.

The above emulsion was heated to 56° C. First, 1 g, in terms of Ag, of an emulsion of 0.05 μm (grain size) pure AgBr fine grains was added to thereby effect shell covering. Subsequently, the following sensitizing dyes 1, 2 and 3 in the form of solid fine dispersion were added in respective amounts of $5.85\times10^{-4}$ mol, $3.06\times10^{-4}$ mol and $9.00\times10^{-6}$ mol per mol of silver. The solid fine dispersions of sensitizing dyes 1, 2 and 3 were prepared in the following manner. The preparation conditions are specified in Table 1. Inorganic salts were dissolved in ion-exchanged water, and the sensitizing dye was added. The sensitizing dye was dispersed at 60° C. for 20 min under agitation at 2000 rpm by means of a dissolver blade. Thus, the solid fine dispersions of sensitizing dyes 1, 2 and 3 were obtained. When, after the addition of the sensitizing dyes, the sensitizing dye adsorption reached 90% of the equilibrium-state adsorption, calcium nitrate was added so that the calcium concentration became 250 ppm. The adsorption amount of sensitizing dye was determined by separating the mixture into a solid layer and a liquid layer (supernatant) by centrifugal precipitation and measuring the difference between the amount of initially added sensitizing dye and the amount of sensitizing dye present in the supernatant to thereby calculate the amount of adsorbed sensitizing dye. After the addition of calcium nitrate, potassium thiocyanate, chloroauric acid, sodium thiosulfate, N,N-dimethylselenourea and compound 4 were added to thereby effect the optimum chemical sensitization. N,N-dimethylselenourea was added in an amount of $3.40\times10^{-6}$ mol per mol of silver. Upon the completion of the chemical sensitization, the following compounds 2 and 3 were added to thereby obtain emulsion Em-A.

Sensitizing dye1

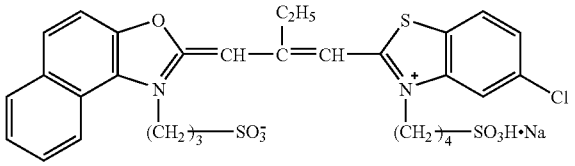

-continued

Sensitizing dye 2

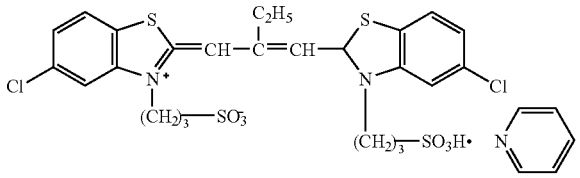

Sensitizing dye 3

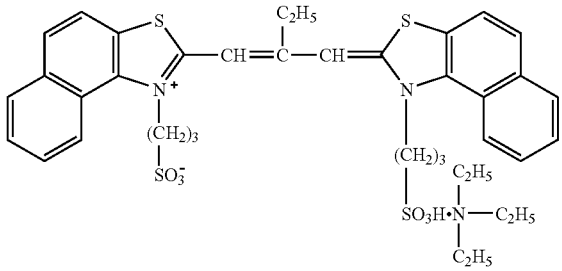

Compound 2

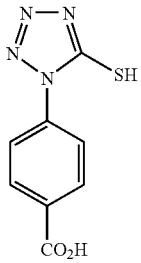

Compound 3

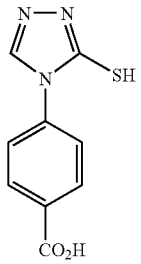

TABLE 1

| Sensitizing dye | Sensitizing dye amount (parts by mass) | $NaNO_3/Na_2SO_4$ (parts by mass) | Water (parts by mass) | Dispersion time | Dispersion temperature |
|---|---|---|---|---|---|
| 1 | 3 | 0.8/3.2 | 43 | 20 minutes | 60° C. |
| 2/3 | 4/0.12 | 0.6/2.4 | 42.8 | 20 minutes | 60° C. |

(Preparation of Em-B)

Emulsion Em-B was prepared in the same manner as the emulsion Em-A, except that the amount of KBr added after nucleation was changed to 5 g, that the addition amount of compound 1 was changed to 8.0 g in terms of KI, that the amounts of sensitizing dyes 1, 2 and 3 added prior to the chemical sensitization were changed to $6.50\times10^{-4}$ mol, $3.40\times10^{-4}$ mol and $1.00\times10^{-5}$ mol, respectively, and that the amount of N,N-dimethylselenourea added at the time of chemical sensitization was changed to $4.00\times10^{-6}$ mol.

(Preparation of Em-C)

Emulsion Em-C was prepared in the same manner as the emulsion Em-A, except that the amount of KBr added after nucleation was changed to 1.5 g, that the addition amount of compound 1 was changed to 7.1 g in terms of KI, that the amounts of sensitizing dyes 1, 2 and 3 added prior to the chemical sensitization were changed to $7.80\times10^{-4}$ mol, $4.08\times10^{-4}$ mol and $1.20\times10^{-5}$ mol, respectively, and that the amount of N,N-dimethylselenourea added at the time of chemical sensitization was changed to $5.00\times10^{-6}$ mol.

(Preparation of Em-E)

Emulsion Em-E was prepared in the same manner as the emulsion Em-A, except that the addition amount of compound 1 was changed to 8.0 g in terms of KI, that the sensitizing dyes 1, 2 and 3 added prior to the chemical sensitization were changed to the sensitizing dyes 4, 5 and 6, respectively, and that the addition amounts of sensitizing dyes 4, 5 and 6 were changed to $7.73\times10^{-4}$ mol, $1.65\times10^{-4}$ mol and $6.20\times10^{-5}$ mol, respectively.

Sensitizing dye 4

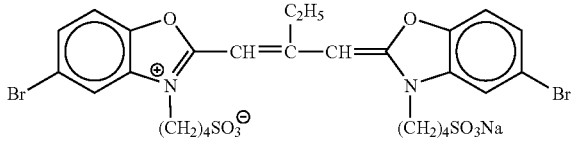

Sensitizing dye 5

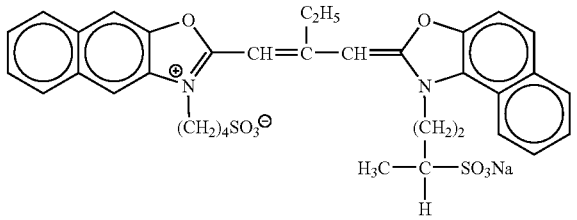

Sensitiing dye 6

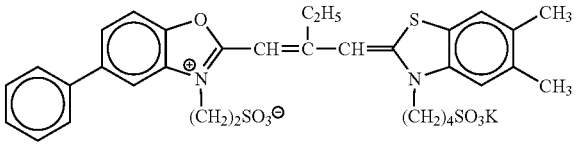

(Preparation of Em-F)

Emulsion Em-F was prepared in the same manner as the emulsion Em-B, except that the addition amount of compound 1 was changed to 9.2 g in terms of KI, that the sensitizing dyes 1, 2 and 3 added prior to the chemical sensitization were changed to the sensitizing dyes 4, 5 and 6, respectively, and that the addition amounts of sensitizing dyes 4, 5 and 6 were changed to $8.50\times10^{-4}$ mol, $1.82\times10^{-4}$ mol and $6.82\times10^{-5}$ mol, respectively.

(Preparation of Em-G)

Emulsion Em-G was prepared in the same manner as the emulsion Em-C, except that the sensitizing dyes 1, 2 and 3 added prior to the chemical sensitization were changed to the sensitizing dyes 4, 5 and 6, respectively, and that the addition amounts of sensitizing dyes 4, 5 and 6 were changed to $1.00\times10^{-3}$ mol, $2.15\times10^{-4}$ mol and $8.06\times10^{-5}$ mol, respectively.

(Preparation of Em-J)

Emulsion Em-J was prepared in the same manner as the emulsion Em-B, except that the sensitizing dyes 1, 2 and 3 added prior to the chemical sensitization were changed to the sensitizing dyes 7 and 8, and that the addition amounts of the sensitizing dyes 7 and 8 were $7.65\times10^{-4}$ mol and $2.74\times10^{-4}$ mol, respectively.

Sensitizing dye 7

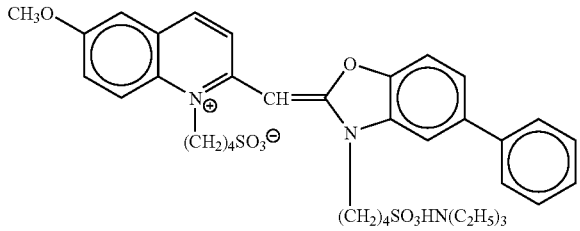

Sensitizing dye 8

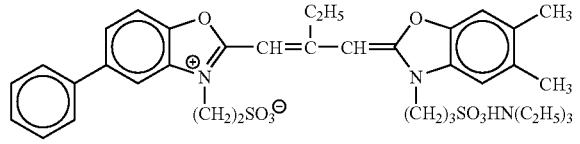

(Preparation of Em-L)

(Preparation of Silver Bromide Seed Crystal Emulsion)

A silver bromide tabular emulsion having an average equivalent sphere diameter of 0.6 μm and an aspect ratio of 9.0 and containing 1.16 mol of silver and 66 g of gelatin per kg of emulsion was provided.

(Growth Step 1)

0.3 g of a modified silicone oil was added to 1250 g of an aqueous solution containing 1.2 g of potassium bromide and a gelatin converted to succinate at a ratio of 98%. The above silver bromide tabular emulsion was added in an amount containing 0.086 mol of silver and, while maintaining the temperature at 78° C., agitated. Further, an aqueous solution containing 18.1 g of silver nitrate and 5.4 mol, per added silver, of the above silver iodide fine grains of 0.037 μm were added. During this period, also, an aqueous solution of potassium bromide was added by double jet while regulating the addition so that the pAg was 8.1.

(Growth Step 2)

2 mg of sodium benzenethiosulfonate was added, and thereafter 0.45 g of disodium salt of 3,5-disulfocatechol and 2.5 mg of thiourea dioxide were added.

Further, an aqueous solution containing 95.7 g of silver nitrate and an aqueous solution of potassium bromide were added by double jet while increasing the flow rate over a period of 66 min. During this period, 7.0 mol, per added silver, of the above silver iodide fine grains of 0.037 μm were added. The amount of potassium bromide added by double jet was regulated so that the pAg was 8.1. After the completion of the addition, 2 mg of sodium benzenethiosulfonate was added.

(Growth Step 3)

An aqueous solution containing 19.5 g of silver nitrate and an aqueous solution of potassium bromide were added by double jet over a period of 16 min. During this period, the amount of the aqueous solution of potassium bromide was regulated so that the pAg was 7.9.

(Addition of Silver Halide Emulsion of Low Solubility 4)

The above host grains were adjusted to 9.3 in pAg with the use of an aqueous solution of potassium bromide. Thereafter, 25 g of the above silver iodide fine grain emulsion of 0.037 μm was rapidly added within a period of 20 sec.

(Formation of Outermost Shell Layer 5)

Further, an aqueous solution containing 34.9 g of silver nitrate was added over a period of 22 min.

The obtained emulsion consisted of tabular grains having an average aspect ratio of 9.8 and an average equivalent sphere diameter of 1.4 μm, wherein the average silver iodide content was 5.5 mol.

(Chemical Sensitization)

The emulsion was washed, and a gelatin converted to succinate at a ratio of 98% and calcium nitrate were added. At 40° C., the pH and pAg were adjusted to 5.8 and 8.7, respectively. The temperature was raised to 60° C., and $5\times10^{-3}$ mol of 0.07 μm silver bromide fine grain emulsion was added. 20 min later, the following sensitizing dyes 9, 10 and 11 were added. Thereafter, potassium thiocyanate, chloroauric acid, sodium thiosulfate, N,N-dimethylselenourea and compound 4 were added to thereby effect the optimum chemical sensitization. Compound 3 was added 20 min before the completion of the chemical sensitization, and compound 5 was added at the completion of the chemical sensitization. The terminology "optimum chemical sensitization" used herein means that the sensitizing dyes and compounds were added in an amount selected from among the range of $10^{-1}$ to $10^{-8}$ mol per mol of silver halide so that the speed exhibited when exposure was conducted at 1/100 became the maximum.

Sensitizing dye 9

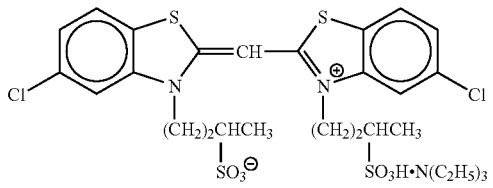

Sensitizing dye 10

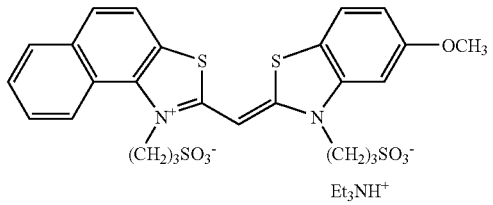

-continued

Sensitizing dye 11

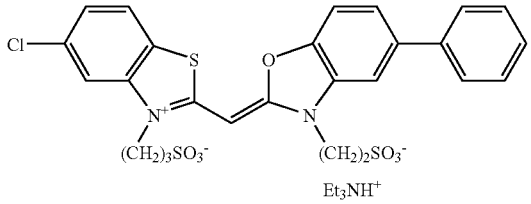

Compound 4

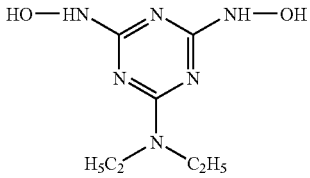

Compound 5

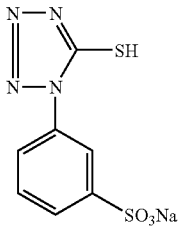

(Preparation of Em-O)

An aqueous solution of gelatin (1250 ml of distilled water, 48 g of deionized gelatin and 0.75 g of KBr) was placed in a reaction vessel equipped with an agitator. The temperature of the aqueous solution was maintained at 70° C. 276 ml of an aqueous solution of $AgNO_3$ (containing 12.0 g of $AgNO_3$) and an equimolar-concentration aqueous solution of KBr were added thereto by the controlled double jet addition method over a period of 7 min while maintaining the pAg at 7.26. The mixture was cooled to 68° C., and 7.6 ml of thiourea dioxide (0.05% by weight) was added.

Subsequently, 592.9 ml of an aqueous solution of $AgNO_3$ (containing 108.0 g of $AgNO_3$) and an equimolar-concentration aqueous solution of a mixture of KBr and KI (2.0 mol % KI) were added by the controlled double jet addition method over a period of 18 min 30 sec while maintaining the pAg at 7.30. Further, 18.0 ml of thiosulfonic acid (0.1% by weight) was added 5 min before the completion of the addition.

The obtained grains consisted of cubic grains having an average equivalent sphere diameter of 0.19 μm and an average silver iodide content of 1.8 mol %.

The obtained emulsion Em-O was desalted and washed by the customary flocculation method, and re-dispersed. At 40° C., the pH and pAg were adjusted to 6.2 and 7.6, respectively.

The resultant emulsion Em-O was subjected to the following spectral and chemical sensitization.

Based on silver, $3.37\times10^{-4}$ mol/mol of each of sensitizing dyes 10, 11 and 12, $8.82\times10^{-4}$ mol/mol of KBr, $8.83\times10^{-5}$ mol/mol of sodium thiosulfate, $5.95\times10^{-4}$ mol/mol of potassium thiocyanate and $3.07\times10^{-5}$ mol/mol of potassium chloroaurate were added. Ripening thereof was performed at 68° C. for a period, which period was regulated so that the photographic speed exhibited when exposure was conducted at 1/100 sec became the maximum.

Sensitizing dye 12

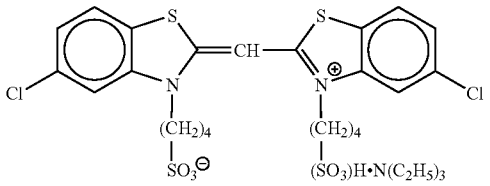

(Em-D, H, I, K, M, N)

In the preparation of tabular grains, a low-molecular-weight gelatin was used in conformity with Examples of JP-A-1-158426. Gold sensitization, sulfur sensitization and selenium sensitization were carried out in the presence of spectral sensitizing dye listed in Table 2 and sodium thiocyanate in conformity with Examples of JP-A-3-237450. Emulsions D, H, I and K contained the optimum amount of Ir and Fe. For the emulsions M and N, reduction sensitization was carried out with the use of thiourea dioxide and thiosulfonic acid at the time of grain preparation in conformity with Examples of JP-A-2-191938.

TABLE 2

| Emulsion name | Sensitizing dye | Addition amount (mol/mol silver) |
|---|---|---|
| Em-D | Sensitizing dye 1 | $5.44 \times 10^{-4}$ |
| | Sensitizing dye 2 | $2.35 \times 10^{-4}$ |
| | Sensitizing dye 3 | $7.26 \times 10^{-6}$ |
| Em-H | Sensitizing dye 8 | $6.52 \times 10^{-4}$ |
| | Sensitizing dye 13 | $1.35 \times 10^{-4}$ |
| | Sensitizing dye 6 | $2.48 \times 10^{-5}$ |
| Em-I | Sensitizing dye 8 | $6.09 \times 10^{-4}$ |
| | Sensitizing dye 13 | $1.26 \times 10^{-4}$ |
| | Sensitizing dye 6 | $2.32 \times 10^{-5}$ |
| Em-K | Sensitizing dye 7 | $6.27 \times 10^{-4}$ |
| | Sensitizing dye 8 | $2.24 \times 10^{-4}$ |
| Em-M | Sensitizing dye 9 | $2.43 \times 10^{-4}$ |
| | Sensitizing dye 10 | $2.43 \times 10^{-4}$ |
| | Sensitizing dye 11 | $2.43 \times 10^{-4}$ |

TABLE 2-continued

| Emulsion name | Sensitizing dye | Addition amount (mol/mol silver) |
|---|---|---|
| Em-N | Sensitizing dye 9 | $3.28 \times 10^{-4}$ |
| | Sensitizing dye 10 | $3.28 \times 10^{-4}$ |
| | Sensitizing dye 11 | $3.28 \times 10^{-4}$ |

Sensitizing dye 13

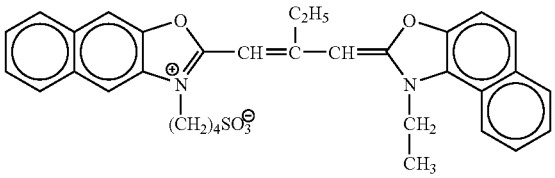

The characteristics of the above emulsions are listed in Table 3.

TABLE 3

| Emulsion name | Average iodide (mol %) | Equivalent-sphere average diameter (μm) | Average aspect ratio | Equivalent-circle average diameter (μm) | Average grain thickness (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

Dislocation lines as described in JP-A-3-237450 were observed in the tabular grains of Table 3 when the observation was conducted through a high-voltage electron microscope.

1) Coating of Light-sensitive Layers (Making of Sample 101)

An undercoated cellulose triacetate film support was coated with multiple layers having compositions presented below to make sample 101 as a multilayered color light-sensitive material.

(Compositions of Light-sensitive Layers)

The main materials used in the individual layers are classified as follows.

ExC: Cyan coupler UV: Ultraviolet absorbent

ExM: Magenta coupler HBS: High-boiling organic solvent

ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| | | |
|---|---|---|
| **1st layer (1st antihalation layer)** | | |
| Black colloidal silver | silver | 0.109 |
| Gelatin | | 0.677 |
| HBS-1 | | 0.004 |
| HBS-2 | | 0.002 |
| **2nd layer (2nd antihalation layer)** | | |
| Black colloidal silver | silver | 0.043 |
| Gelatin | | 0.313 |
| HBS-1 | | 0.054 |
| **3rd layer (Interlayer)** | | |
| Cpd-1 | | 0.082 |
| HBS-1 | | 0.050 |
| Gelatin | | 0.424 |
| **4th layer (Low-speed red-sensitive emulsion layer)** | | |
| Em-D | silver | 0.392 |
| Em-C | silver | 0.384 |
| ExC-1 | | 0.204 |
| ExC-2 | | 0.021 |
| ExC-3 | | 0.127 |
| ExC-4 | | 0.111 |
| ExC-5 | | 0.032 |
| ExC-6 | | 0.014 |
| Cpd-2 | | 0.025 |
| Cpd-4 | | 0.008 |
| ExC-8 | | 0.010 |
| HBS-1 | | 0.220 |
| HBS-5 | | 0.038 |
| Gelatin | | 2.412 |
| **5th layer (Medium-speed red-sensitive emulsion layer)** | | |
| Em-B | silver | 0.799 |
| Em-C | silver | 0.364 |
| ExC-1 | | 0.074 |
| ExC-2 | | 0.034 |
| ExC-3 | | 0.004 |
| ExC-4 | | 0.050 |
| ExC-5 | | 0.013 |
| ExC-6 | | 0.025 |
| Cpd-2 | | 0.036 |
| Cpd-4 | | 0.008 |
| Cpd-6 | | 0.060 |
| ExC-7 | | 0.010 |
| HBS-1 | | 0.097 |
| Gelatin | | 1.025 |
| **6th layer (High-speed red-sensitive emulsion layer)** | | |
| Em-A | silver | 0.666 |
| Em-B | silver | 0.291 |
| ExC-1 | | 0.038 |
| ExC-3 | | 0.009 |
| ExC-6 | | 0.035 |
| Cpd-2 | | 0.064 |
| Cpd-4 | | 0.009 |
| Cpd-6 | | 0.025 |
| ExC-7 | | 0.079 |
| HBS-1 | | 0.263 |
| Gelatin | | 0.957 |
| **7th layer (Interlayer)** | | |
| Cpd-1 | | 0.094 |
| Cpd-7 | | 0.369 |
| HBS-1 | | 0.049 |
| Polyethylacrylate latex | | 0.088 |
| Gelatin | | 0.886 |
| **8th layer (layer for donating interlayer effect to red-sensitive layer)** | | |
| Em-J | silver | 0.200 |
| Em-K | silver | 0.131 |
| Cpd-4 | | 0.030 |
| ExM-2 | | 0.098 |
| ExM-3 | | 0.002 |

-continued

| | | |
|---|---|---|
| ExY-1 | | 0.008 |
| ExY-6 | | 0.045 |
| ExC-9 | | 0.034 |
| HBS-1 | | 0.200 |
| HBS-3 | | 0.005 |
| HBS-5 | | 0.025 |
| Gelatin | | 0.673 |
| **9th layer (Low-speed green-sensitive emulsion layer)** | | |
| Em-G | silver | 0.553 |
| Em-H | silver | 0.378 |
| Em-I | silver | 0.088 |
| ExM-2 | | 0.280 |
| ExM-3 | | 0.053 |
| ExY-1 | | 0.005 |
| ExC-9 | | 0.008 |
| HBS-1 | | 0.131 |
| HBS-3 | | 0.013 |
| HBS-4 | | 0.135 |
| HBS-5 | | 0.270 |
| Gelatin | | 1.325 |
| **10th layer (Medium-speed green-sensitive emulsion layer)** | | |
| Em-F | silver | 0.486 |
| Em-G | silver | 0.347 |
| ExM-2 | | 0.159 |
| ExM-3 | | 0.020 |
| ExY-1 | | 0.003 |
| ExY-5 | | 0.006 |
| ExC-6 | | 0.005 |
| ExC-7 | | 0.010 |
| ExC-9 | | 0.012 |
| HBS-1 | | 0.100 |
| HBS-3 | | 0.003 |
| HBS-5 | | 0.020 |
| Gelatin | | 0.852 |
| **11th layer (High-speed green-sensitive emulsion layer)** | | |
| Em-E | silver | 0.437 |
| ExC-6 | | 0.009 |
| ExC-7 | | 0.010 |
| ExM-1 | | 0.031 |
| ExM-2 | | 0.014 |
| ExM-3 | | 0.010 |
| ExY-5 | | 0.003 |
| Cpd-3 | | 0.003 |
| Cpd-4 | | 0.004 |
| HBS-1 | | 0.060 |
| HBS-5 | | 0.037 |
| Polyethylacrylate latex | | 0.090 |
| Gelatin | | 0.437 |
| **12th layer (Yellow filter layer)** | | |
| Yellow colloidal silver | silver | 0.042 |
| Cpd-1 | | 0.090 |
| Solid disperse dye ExF-2 | | 0.050 |
| Solid disperse dye ExF-5 | | 0.010 |
| Oil-soluble dye ExF-7 | | 0.010 |
| HBS-1 | | 0.055 |
| Gelatin | | 0.908 |
| **13th layer (Low-speed blue-sensitive emulsion layer)** | | |
| Em-O | silver | 0.120 |
| Em-M | silver | 0.287 |
| Em-N | silver | 0.216 |
| ExC-1 | | 0.017 |
| ExY-1 | | 0.009 |
| ExY-2 | | 0.688 |
| ExY-6 | | 0.027 |
| ExC-9 | | 0.009 |
| Cpd-2 | | 0.050 |
| Cpd-3 | | 0.004 |
| HBS-1 | | 0.258 |
| HBS-5 | | 0.074 |
| Gelatin | | 1.514 |

-continued

| | | |
|---|---|---|
| **14th layer (High-speed blue-sensitive emulsion layer)** | | |
| Em-L | silver | 0.546 |
| ExY-2 | | 0.155 |
| ExY-6 | | 0.062 |
| Cpd-2 | | 0.075 |
| Cpd-3 | | 0.001 |
| HBS-1 | | 0.071 |
| Gelatin | | 0.678 |
| **15th layer (1st protective layer)** | | |
| 0.07-μm silver iodobromide emulsion | silver | 0.242 |
| UV-1 | | 0.240 |
| UV-2 | | 0.120 |
| UV-3 | | 0.170 |
| UV-4 | | 0.017 |
| F-11 | | 0.002 |
| S-1 | | 0.068 |
| HBS-1 | | 0.030 |
| HBS-4 | | 0.139 |
| Gelatin | | 2.002 |
| **16th layer (2nd protective layer)** | | |
| H-1 | | 0.400 |
| B-1 (diameter 1.7 μm) | | 0.007 |
| B-2 (diameter 1.7 μm) | | 0.160 |
| B-3 | | 0.029 |
| Gelatin | | 0.742 |

storage stability, processability, resistance to pressure, antiseptic and mildewproofing properties, antistatic properties, and coating properties, the individual layers contained W-1 to W-6, B-4 to B-6, F-1 to F-17, lead salt, platinum salt, iridium salt, and rhodium salt.

Preparation of Dispersions of Organic Solid Disperse Dyes

| ExF-2 in the 12th layer was dispersed by the following method. | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total | 7.210 kg |

(pH was Adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid fine-grain dispersion. The average grain size of the fine dye grains was 0.29 μm.

ExF-5 was dispersed by a microprecipitation dispersion method described in Example 1 of EP549,489A, the disclosure of which is incorporated herein by reference. The average grain size was found to be 0.06 μm.

Compounds used in the formation of each layer were as follows.

ExC-1

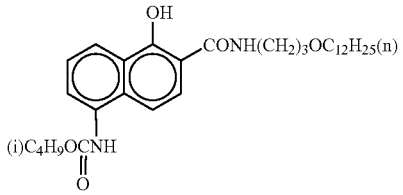

ExC-2

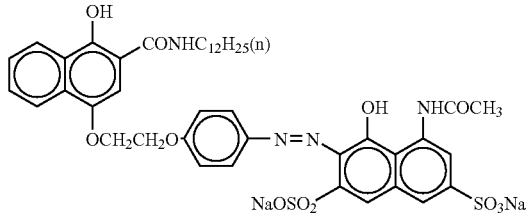

ExC-3

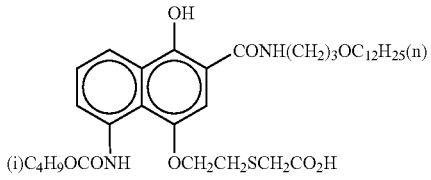

ExC-4

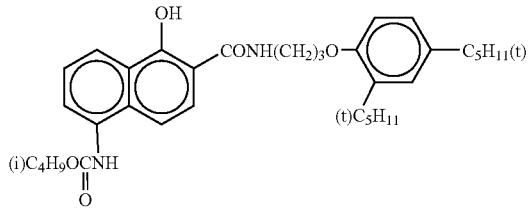

-continued
ExC-5
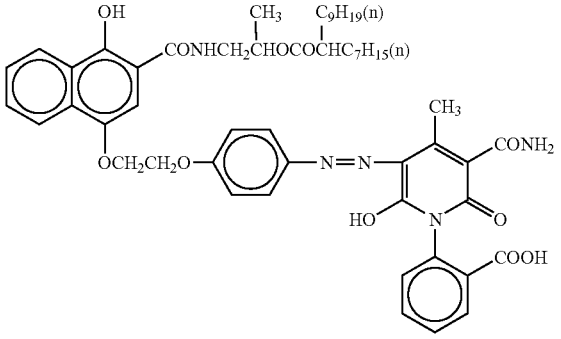
ExC-6
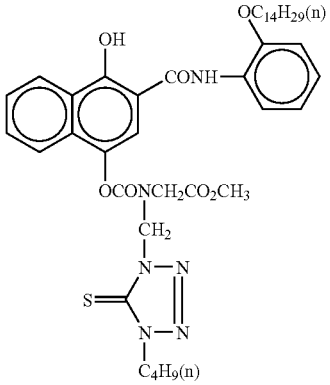
ExC-7
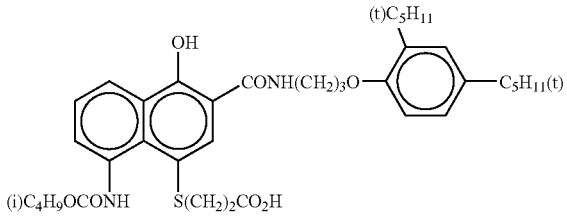
ExC-8
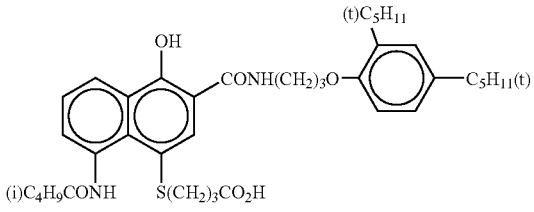
ExC-9
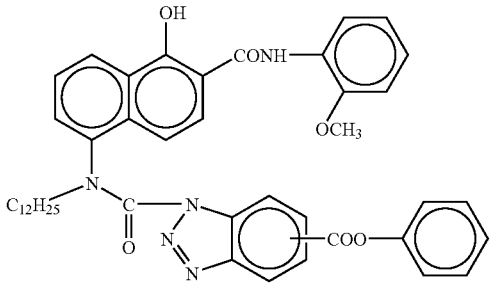
ExM-1
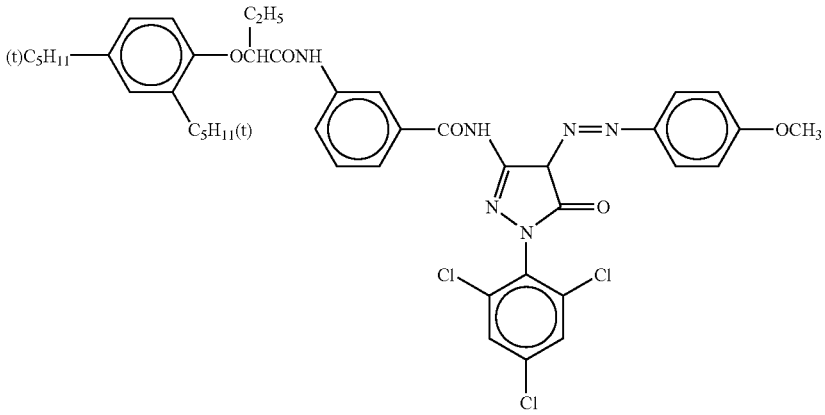

-continued
ExM-2
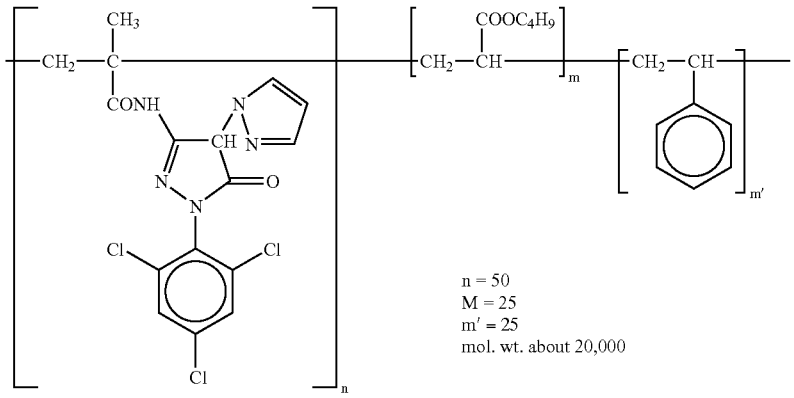
ExM-3
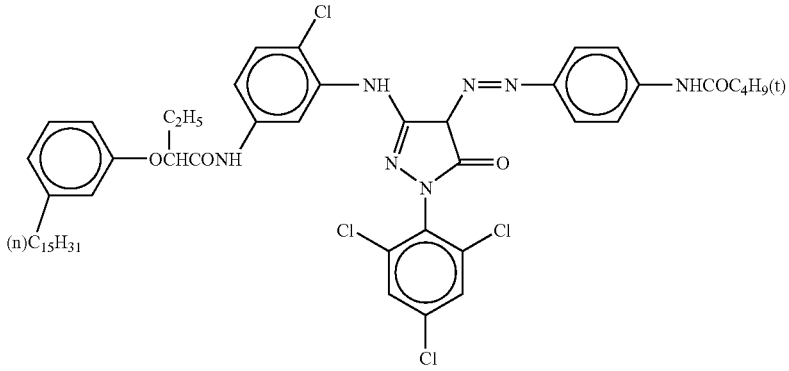
ExM-4
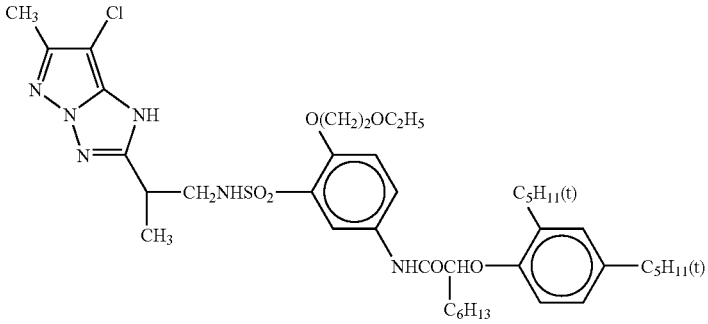
EXY-1
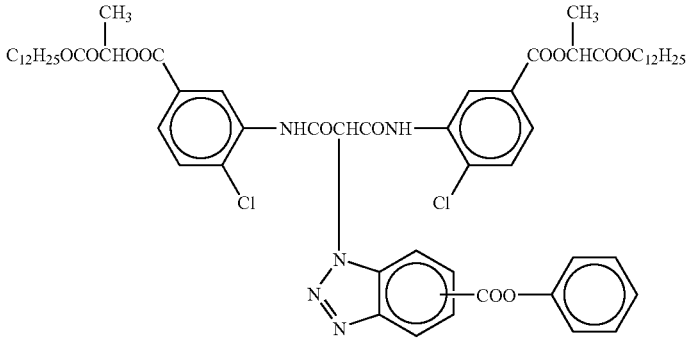

-continued
ExY-2
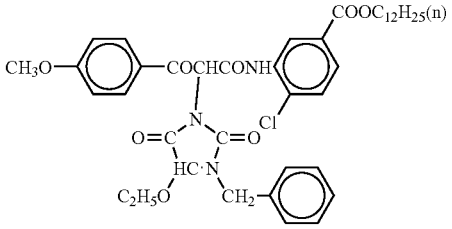
ExY-5
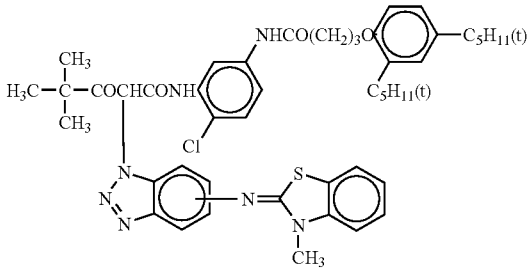
ExY-6
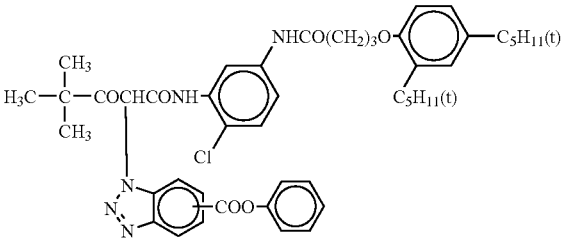
Cpd-1
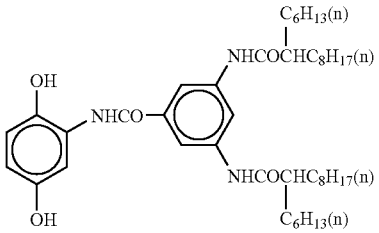
Cpd-2
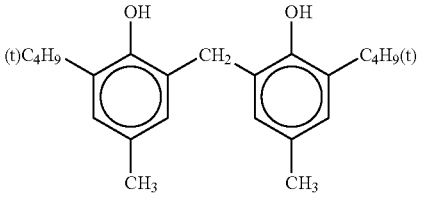
Cpd-3
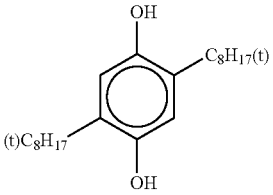
Cpd-4
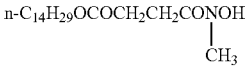
Cpd-5
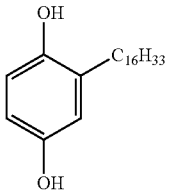
Cpd-6
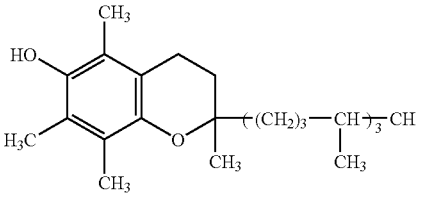
UV-1
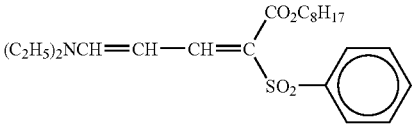
UV-2
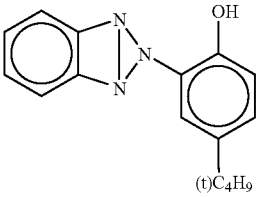
UV-3
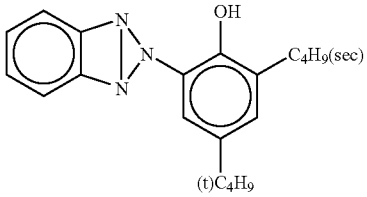
UV-4
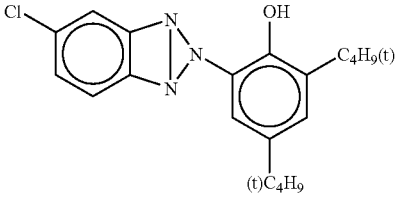
B-1
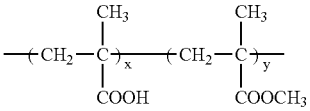
x/y = 10/90 (mass ratio)
Weight-average molecular weight: about 35,000

-continued
B-2
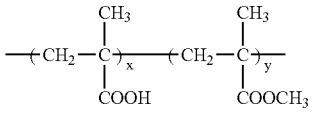
x/y = 40/60 (mass ratio)
Weight-average molecular weight: about 20,000
B-3
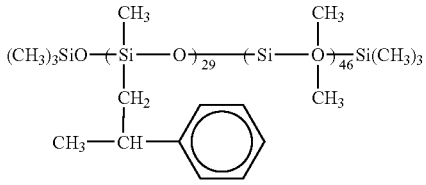
(molar ratio)
Weight-average molecular weight: about 8,000
H-1
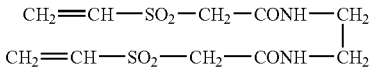
S-1
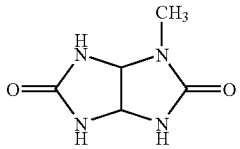
HBS-1
Tricresyl phosphate
HBS-2
Di-n-buthyl phthalate
HBS-3
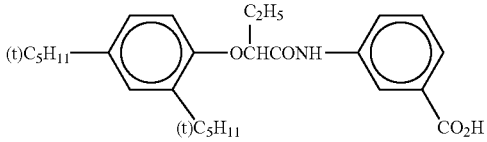
HBS-4
Tri(2-ethylhexyl) phosphate
HBS-5
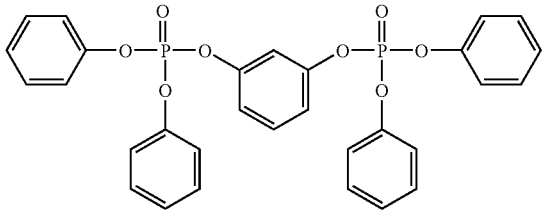
F-1
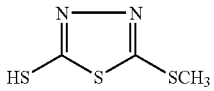
F-2
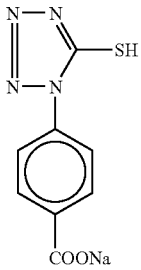
F-3
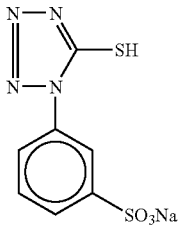
F-4
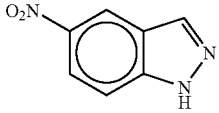
F-5
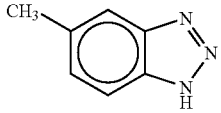
F-6
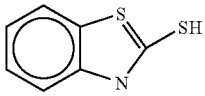
F-7
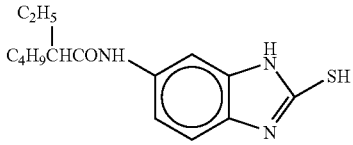

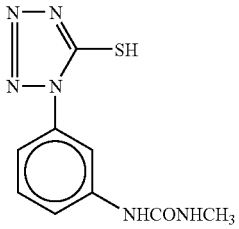
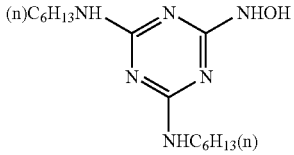
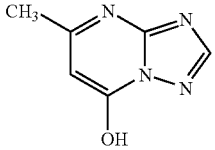
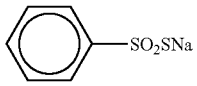
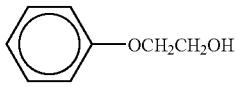
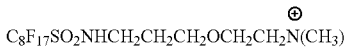
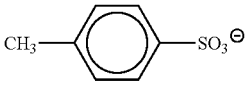
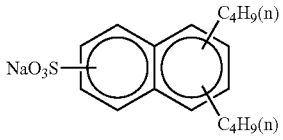
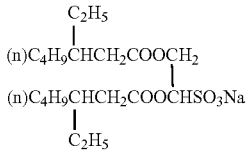
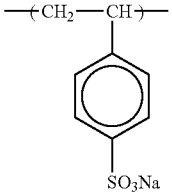
Weight-average molecular weight: about 750,000
-continued
F-8
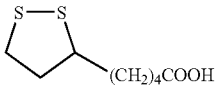
F-9
F-10
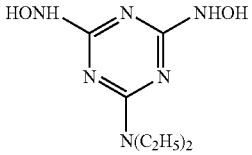
F-11
F-12
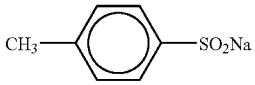
F-13
F-14
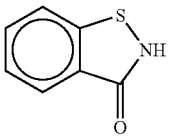
F-15
F-16
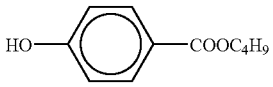
F-17
W-1
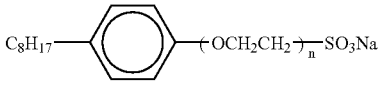
n = 2~4
W-2
W-3
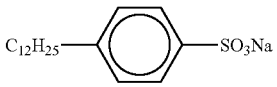
W-4
W-5
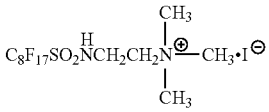
W-6
B-4
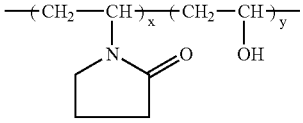
x/y = 70/30 (mass ratio)
Weight-average molecular weight: about 17,000
B-5

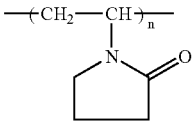

Weight-average molecular weight: about 10,000

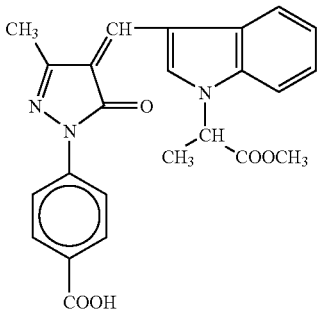

ExF-2

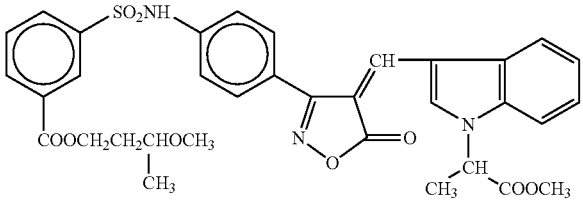

ExF-7

-continued

B-6

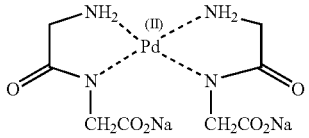

Cpd-7

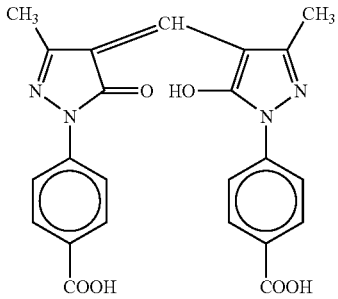

ExF-5

(Making of Sample 102)

Sample 102 was made as follows by replacing the coating amounts in the 1st to 16th layers of sample 101.

The number corresponding to each component indicates the coating amount in units of g/m$^2$. The coating amount of a silver halide is indicated by the amount of silver.

| | | |
|---|---|---|
| **1st layer (1st antihalation layer)** | | |
| Black colloidal silver | silver | 0.109 |
| Gelatin | | 0.677 |
| HBS-1 | | 0.004 |
| HBS-2 | | 0.002 |
| **2nd layer (2nd antihalation layer)** | | |
| Black colloidal silver | silver | 0.043 |
| Gelatin | | 0.313 |
| HBS-1 | | 0.054 |
| **3rd layer (Interlayer)** | | |
| Cpd-1 | | 0.041 |
| HBS-1 | | 0.025 |
| Gelatin | | 0.212 |
| **4th layer (Low-speed red-sensitive emulsion layer)** | | |
| Em-D | silver | 0.292 |
| Em-C | silver | 0.096 |
| ExC-1 | | 0.090 |
| ExC-3 | | 0.080 |
| ExC-4 | | 0.050 |
| Cpd-2 | | 0.013 |
| Cpd-4 | | 0.004 |
| ExC-8 | | 0.005 |
| HBS-1 | | 0.110 |
| HBS-5 | | 0.019 |
| Gelatin | | 1.206 |

-continued

| | | |
|---|---|---|
| **5th layer (Medium-speed red-sensitive emulsion layer)** | | |
| m-B | silver | 0.200 |
| Em-C | silver | 0.382 |
| ExC-1 | | 0.030 |
| ExC-3 | | 0.030 |
| ExC-4 | | 0.025 |
| Cpd-2 | | 0.018 |
| Cpd-4 | | 0.004 |
| Cpd-6 | | 0.030 |
| ExC-7 | | 0.005 |
| HBS-1 | | 0.049 |
| Gelatin | | 0.513 |
| **6th layer (High-speed red-sensitive emulsion layer)** | | |
| Em-A | silver | 0.466 |
| Em-B | silver | 0.204 |
| ExC-1 | | 0.010 |
| ExC-3 | | 0.060 |
| Cpd-2 | | 0.032 |
| Cpd-4 | | 0.005 |
| Cpd-6 | | 0.013 |
| ExC-7 | | 0.020 |
| HBS-1 | | 0.132 |
| Gelatin | | 0.479 |
| **7th layer (Interlayer)** | | |
| Cpd-1 | | 0.047 |
| Cpd-7 | | 0.185 |
| HBS-1 | | 0.025 |
| Polyethylacrylate latex | | 0.044 |
| Gelatin | | 0.443 |
| **8th layer (layer for donating interlayer effect to red-sensitive layer)** | | |
| Em-J | silver | 0.100 |
| Em-K | silver | 0.066 |
| Cpd-4 | | 0.015 |
| ExM-2 | | 0.050 |
| ExY-1 | | 0.004 |

-continued

| | | |
|---|---|---|
| ExY-6 | | 0.023 |
| ExC-9 | | 0.017 |
| HBS-1 | | 0.100 |
| HBS-3 | | 0.003 |
| HBS-5 | | 0.013 |
| Gelatin | | 0.337 |
| 9th layer (Low-speed green-sensitive emulsion layer) | | |
| Em-G | silver | 0.139 |
| Em-H | silver | 0.189 |
| Em-I | silver | 0.183 |
| ExM-2 | | 0.167 |
| HBS-1 | | 0.066 |
| HBS-3 | | 0.007 |
| HBS-4 | | 0.068 |
| HBS-5 | | 0.135 |
| Gelatin | | 0.663 |
| 10th layer (Medium-speed green-sensitive emulsion layer) | | |
| Em-F | silver | 0.122 |
| Em-G | silver | 0.296 |
| ExM-2 | | 0.090 |
| ExC-7 | | 0.005 |
| HBS-1 | | 0.050 |
| HBS-3 | | 0.002 |
| HBS-5 | | 0.010 |
| Gelatin | | 0.426 |
| 11th layer (High-speed green-sensitive emulsion layer) | | |
| Em-E | silver | 0.146 |
| Em-F | silver | 0.073 |
| ExC-7 | | 0.005 |
| ExM-2 | | 0.028 |
| Cpd-3 | | 0.002 |
| Cpd-4 | | 0.002 |
| HBS-1 | | 0.030 |
| HBS-5 | | 0.019 |
| Polyethylacrylate latex | | 0.045 |
| Gelatin | | 0.219 |
| 12th layer (Yellow filter layer) | | |
| Yellow colloidal silver | silver | 0.042 |
| Cpd-1 | | 0.045 |
| Solid disperse dye ExF-2 | | 0.050 |
| Solid disperse dye ExF-5 | | 0.010 |
| Oil-soluble dye ExF-7 | | 0.010 |
| HBS-1 | | 0.040 |
| Gelatin | | 0.750 |
| 13th layer (Low-speed blue-sensitive emulsion layer) | | |
| Em-O | silver | 0.132 |
| Em-M | silver | 0.072 |
| Em-N | silver | 0.108 |
| ExY-2 | | 0.363 |
| Cpd-2 | | 0.025 |
| Cpd-3 | | 0.002 |
| HBS-1 | | 0.129 |
| HBS-5 | | 0.037 |
| Gelatin | | 0.757 |
| 14th layer (High-speed blue-sensitive emulsion layer) | | |
| Em-L | silver | 0.382 |
| ExY-2 | | 0.109 |
| Cpd-2 | | 0.038 |
| Cpd-3 | | 0.001 |
| HBS-1 | | 0.036 |
| Gelatin | | 0.339 |
| 15th layer (1st protective layer) | | |
| 0.07-μm silver iodobromide emulsion | silver | 0.121 |
| UV-1 | | 0.240 |
| UV-2 | | 0.120 |
| UV-3 | | 0.170 |
| UV-4 | | 0.017 |
| F-11 | | 0.002 |
| S-1 | | 0.068 |
| HBS-1 | | 0.030 |
| HBS-4 | | 0.139 |
| Gelatin | | 2.002 |

-continued

| | | |
|---|---|---|
| 16th layer (2nd protective layer) | | |
| H-1 | | 0.400 |
| B-1 (diameter 1.7 μm) | | 0.007 |
| B-2 (diameter 1.7 μm) | | 0.160 |
| B-3 | | 0.029 |
| Gelatin | | 0.742 |

In addition to the above components, to improve the storage stability, processability, resistance to pressure, antiseptic and mildewproofing properties, antistatic properties, and coating properties, the individual layers contained W-1 to W-6, B-4 to B-6, F-1 to F-17, lead salt, platinum salt, iridium salt, and rhodium salt.

(Making of Sample 103)

Sample 103 was made by changing the coating amounts of Em-A to Em-O in the 1st to 16th layers of sample 102 to the same as of sample 101.

(Making of Sample 104)

Sample 104 was made as follows by replacing the coating amounts in the 1st to 16th layers of sample 101.

The number corresponding to each component indicates the coating amount in units of g/m$^2$. The coating amount of a silver halide is indicated by the amount of silver.

| | | |
|---|---|---|
| 1st layer (1st antihalation layer) | | |
| Black colloidal silver | silver | 0.109 |
| Gelatin | | 0.677 |
| HBS-1 | | 0.004 |
| HBS-2 | | 0.002 |
| 2nd layer (2nd antihalation layer) | | |
| Black colloidal silver | silver | 0.043 |
| Gelatin | | 0.313 |
| HBS-1 | | 0.054 |
| 3rd layer (Interlayer) | | |
| Cpd-1 | | 0.041 |
| HBS-1 | | 0.025 |
| Gelatin | | 0.212 |
| 4th layer (Low-speed red-sensitive emulsion layer) | | |
| Em-D | silver | 0.292 |
| Em-C | silver | 0.096 |
| ExC-1 | | 0.090 |
| ExC-3 | | 0.086 |
| ExC-4 | | 0.050 |
| Cpd-2 | | 0.013 |
| Cpd-4 | | 0.004 |
| HBS-1 | | 0.110 |
| HBS-5 | | 0.019 |
| Gelatin | | 1.206 |
| 5th layer (Medium-speed red-sensitive emulsion layer) | | |
| Em-B | silver | 0.200 |
| Em-C | silver | 0.382 |
| ExC-1 | | 0.030 |
| ExC-3 | | 0.036 |
| ExC-4 | | 0.025 |
| Cpd-2 | | 0.018 |
| Cpd-4 | | 0.004 |
| Cpd-6 | | 0.030 |
| HBS-1 | | 0.049 |
| Gelatin | | 0.513 |
| 6th layer (High-speed red-sensitive emulsion layer) | | |
| Em-A | silver | 0.466 |
| Em-B | silver | 0.204 |

-continued

| | | |
|---|---|---|
| ExC-1 | | 0.019 |
| ExC-3 | | 0.070 |
| Cpd-2 | | 0.032 |
| Cpd-4 | | 0.005 |
| Cpd-6 | | 0.013 |
| HBS-1 | | 0.132 |
| Gelatin | | 0.479 |
| 7th layer (Interlayer) | | |
| Cpd-1 | | 0.047 |
| Cpd-7 | | 0.185 |
| HBS-1 | | 0.025 |
| Polyethylacrylate latex | | 0.044 |
| Gelatin | | 0.443 |
| 8th layer (layer for donating interlayer effect to red-sensitive layer) | | |
| Em-J | silver | 0.100 |
| Em-K | silver | 0.066 |
| Cpd-4 | | 0.015 |
| ExM-2 | | 0.050 |
| ExY-1 | | 0.004 |
| ExY-6 | | 0.023 |
| ExC-9 | | 0.017 |
| HBS-1 | | 0.100 |
| HBS-3 | | 0.003 |
| HBS-5 | | 0.013 |
| Gelatin | | 0.337 |
| 9th layer (Low-speed green-sensitive emulsion layer) | | |
| Em-G | silver | 0.139 |
| Em-H | silver | 0.189 |
| Em-I | silver | 0.183 |
| ExM-2 | | 0.167 |
| HBS-1 | | 0.066 |
| HBS-3 | | 0.007 |
| HBS-4 | | 0.068 |
| HBS-5 | | 0.135 |
| Gelatin | | 0.663 |
| 10th layer (Medium-speed green-sensitive emulsion layer) | | |
| Em-F | silver | 0.122 |
| Em-G | silver | 0.296 |
| ExM-2 | | 0.090 |
| HBS-1 | | 0.050 |
| HBS-3 | | 0.002 |
| HBS-5 | | 0.010 |
| Gelatin | | 0.426 |
| 11th layer (High-speed green-sensitive emulsion layer) | | |
| Em-E | silver | 0.146 |
| Em-F | silver | 0.073 |
| ExM-2 | | 0.028 |
| Cpd-3 | | 0.002 |
| Cpd-4 | | 0.002 |
| HBS-1 | | 0.030 |
| HBS-5 | | 0.019 |
| Polyethylacrylate latex | | 0.045 |
| Gelatin | | 0.219 |
| 12th layer (Yellow filter layer) | | |
| Yellow colloidal silver | silver | 0.042 |
| Cpd-1 | | 0.045 |
| Solid disperse dye ExF-2 | | 0.050 |
| Solid disperse dye ExF-5 | | 0.010 |
| Oil-soluble dye ExF-7 | | 0.010 |
| HBS-1 | | 0.040 |
| Gelatin | | 0.750 |
| 13th layer (Low-speed blue-sensitive emulsion layer) | | |
| Em-O | silver | 0.132 |
| Em-M | silver | 0.072 |
| Em-N | silver | 0.108 |
| ExY-2 | | 0.363 |
| Cpd-2 | | 0.025 |
| Cpd-3 | | 0.002 |
| HBS-1 | | 0.129 |
| HBS-5 | | 0.037 |
| Gelatin | | 0.757 |

-continued

| | | |
|---|---|---|
| 14th layer (High-speed blue-sensitive emulsion layer) | | |
| Em-L | silver | 0.382 |
| ExY-2 | | 0.109 |
| Cpd-2 | | 0.038 |
| Cpd-3 | | 0.001 |
| HBS-1 | | 0.036 |
| Gelatin | | 0.339 |
| 15th layer (1st protective layer) | | |
| 0.07-μm silver iodobromide emulsion | silver | 0.121 |
| UV-1 | | 0.240 |
| UV-2 | | 0.120 |
| UV-3 | | 0.170 |
| UV-4 | | 0.017 |
| F-11 | | 0.002 |
| S-1 | | 0.068 |
| HBS-1 | | 0.030 |
| HBS-4 | | 0.139 |
| Gelatin | | 2.002 |
| 16th layer (2nd protective layer) | | |
| H-1 | | 0.400 |
| B-1 (diameter 1.7 μm) | | 0.007 |
| B-2 (diameter 1.7 μm) | | 0.160 |
| B-3 | | 0.029 |
| Gelatin | | 0.742 |

In addition to the above components, to improve the storage stability, processability, resistance to pressure, antiseptic and mildewproofing properties, antistatic properties, and coating properties, the individual layers contained W-1 to W-6, B-4 to B-6, F-1to F-17, lead salt platinum salt, iridium salt, and rhodium salt.

(Making of Sample 105)

Sample 105 was made as follows by replacing the coating amounts in the 1st to 16th layers of sample 101.

The number corresponding to each component indicates the coating amount in units of g/m$^2$. The coating amount of a silver halide is indicated by the amount of silver.

| | | |
|---|---|---|
| 1st layer (1st antihalation layer) | | |
| Black colloidal silver | silver | 0.109 |
| Gelatin | | 0.677 |
| HBS-1 | | 0.004 |
| HBS-2 | | 0.002 |
| 2nd layer (2nd antihalation layer) | | |
| Black colloidal silver | silver | 0.043 |
| Gelatin | | 0.313 |
| HBS-1 | | 0.054 |
| 3rd layer (Interlayer) | | |
| Cpd-1 | | 0.082 |
| HBS-1 | | 0.050 |
| Gelatin | | 0.424 |
| 4th layer (Low-speed red-sensitive emulsion layer) | | |
| Em-D | silver | 0.392 |
| Em-C | silver | 0.384 |
| ExC-1 | | 0.102 |
| ExC-2 | | 0.020 |
| ExC-3 | | 0.060 |
| ExC-4 | | 0.060 |
| ExC-5 | | 0.016 |
| ExC-6 | | 0.007 |
| Cpd-2 | | 0.025 |
| Cpd-4 | | 0.008 |
| ExC-8 | | 0.005 |
| HBS-1 | | 0.220 |

-continued

| | | |
|---|---|---|
| HBS-5 | | 0.038 |
| Gelatin | | 2.412 |
| 5th layer (Medium-speed red-sensitive emulsion layer) | | |
| Em-B | silver | 0.799 |
| Em-C | silver | 0.364 |
| ExC-1 | | 0.037 |
| ExC-2 | | 0.017 |
| ExC-3 | | 0.002 |
| ExC-4 | | 0.025 |
| ExC-5 | | 0.006 |
| ExC-6 | | 0.013 |
| Cpd-2 | | 0.036 |
| Cpd-4 | | 0.008 |
| Cpd-6 | | 0.060 |
| ExC-7 | | 0.005 |
| HBS-1 | | 0.097 |
| Gelatin | | 1.025 |
| 6th layer (High-speed red-sensitive emulsion layer) | | |
| Em-A | silver | 0.666 |
| Em-B | silver | 0.291 |
| ExC-1 | | 0.019 |
| ExC-3 | | 0.005 |
| ExC-6 | | 0.017 |
| Cpd-2 | | 0.064 |
| Cpd-4 | | 0.009 |
| Cpd-6 | | 0.025 |
| ExC-7 | | 0.040 |
| HBS-1 | | 0.263 |
| Gelatin | | 0.957 |
| 7th layer (Interlayer) | | |
| Cpd-1 | | 0.094 |
| Cpd-7 | | 0.369 |
| HBS-1 | | 0.049 |
| Polyethylacrylate latex | | 0.088 |
| Gelatin | | 0.886 |
| 8th layer (layer for donating interlayer effect to red-sensitive layer) | | |
| Em-J | silver | 0.200 |
| Em-K | silver | 0.131 |
| Cpd-4 | | 0.030 |
| ExM-2 | | 0.049 |
| ExM-3 | | 0.002 |
| ExY-1 | | 0.004 |
| ExY-6 | | 0.002 |
| ExC-9 | | 0.017 |
| HBS-1 | | 0.200 |
| HBS-3 | | 0.005 |
| HBS-5 | | 0.025 |
| Gelatin | | 0.673 |
| 9th layer (Low-speed green-sensitive emulsion layer) | | |
| Em-G | silver | 0.553 |
| Em-H | silver | 0.378 |
| Em-I | silver | 0.088 |
| ExM-2 | | 0.140 |
| ExM-3 | | 0.027 |
| ExY-1 | | 0.005 |
| ExC-9 | | 0.004 |
| HBS-1 | | 0.131 |
| HBS-3 | | 0.013 |
| HBS-4 | | 0.135 |
| HBS-5 | | 0.270 |
| Gelatin | | 1.325 |
| 10th layer (Medium-speed green-sensitive emulsion layer) | | |
| Em-F | silver | 0.486 |
| Em-G | silver | 0.347 |
| ExM-2 | | 0.080 |
| ExM-3 | | 0.010 |
| ExY-1 | | 0.002 |
| ExY-5 | | 0.003 |
| ExC-6 | | 0.003 |
| ExC-7 | | 0.005 |
| ExC-9 | | 0.006 |
| HBS-1 | | 0.100 |
| HBS-3 | | 0.003 |

-continued

| | | |
|---|---|---|
| HBS-5 | | 0.020 |
| Gelatin | | 0.852 |
| 11th layer (High-speed green-sensitive emulsion layer) | | |
| Em-E | silver | 0.437 |
| ExC-6 | | 0.005 |
| ExC-7 | | 0.005 |
| ExM-1 | | 0.016 |
| ExM-2 | | 0.007 |
| ExM-3 | | 0.005 |
| ExY-5 | | 0.002 |
| Cpd-3 | | 0.003 |
| Cpd-4 | | 0.004 |
| HBS-1 | | 0.060 |
| HBS-5 | | 0.037 |
| Polyethylacrylate latex | | 0.090 |
| Gelatin | | 0.437 |
| 12th layer (Yellow filter layer) | | |
| Yellow colloidal silver | silver | 0.042 |
| Cpd-1 | | 0.090 |
| Solid disperse dye ExF-2 | | 0.050 |
| Solid disperse dye ExF-5 | | 0.010 |
| Oil-soluble dye ExF-7 | | 0.010 |
| HBS-1 | | 0.055 |
| Gelatin | | 0.908 |
| 13th layer (Low-speed blue-sensitive emulsion layer) | | |
| Em-O | silver | 0.120 |
| Em-M | silver | 0.287 |
| Em-N | silver | 0.216 |
| ExC-1 | | 0.008 |
| ExY-1 | | 0.005 |
| ExY-2 | | 0.344 |
| ExY-6 | | 0.019 |
| ExC-9 | | 0.005 |
| Cpd-2 | | 0.050 |
| Cpd-3 | | 0.004 |
| HBS-1 | | 0.258 |
| HBS-5 | | 0.074 |
| Gelatin | | 1.514 |
| 14th layer (High-speed blue-sensitive emulsion layer) | | |
| Em-L | silver | 0.546 |
| ExY-2 | | 0.080 |
| ExY-6 | | 0.040 |
| Cpd-2 | | 0.075 |
| Cpd-3 | | 0.001 |
| HBS-1 | | 0.071 |
| Gelatin | | 0.678 |
| 15th layer (1st protective layer) | | |
| 0.07-μm silver iodobromide emulsion | silver | 0.242 |
| UV-1 | | 0.240 |
| UV-2 | | 0.120 |
| UV-3 | | 0.170 |
| UV-4 | | 0.017 |
| F-11 | | 0.002 |
| S-1 | | 0.068 |
| HBS-1 | | 0.030 |
| HBS-4 | | 0.139 |
| Gelatin | | 2.002 |
| 16th layer (2nd protective layer) | | |
| H-1 | | 0.400 |
| B-1 (diameter 1.7 μm) | | 0.007 |
| B-2 (diameter 1.7 μm) | | 0.160 |
| B-3 | | 0.029 |
| Gelatin | | 0.742 |

In addition to the above components, to improve the storage stability, processability, resistance to pressure, antiseptic and mildewproofing properties, antistatic properties, and coating properties, the individual layers contained W-1 to W-6, B-4 to B-6, F-1 to F-17, lead salt, platinum salt, iridium salt, and rhodium salt.

TABLE 4

| Sample No. | Coupler coating amount (mmol/m²) Cyan dye forming coupler | Magenta dye forming coupler | Yellow dye forming coupler | Total coating amount | Total silver amount (g/m²) |
|---|---|---|---|---|---|
| 101 | 1.5 | 1.1 | 1.3 | 3.9 | 7.12 |
| 102 | 0.69 | 0.34 | 0.74 | 1.77 | 3.96 |
| 103 | 0.69 | 0.34 | 0.74 | 1.77 | 7.12 |
| 104 | 0.68 | 0.34 | 0.74 | 1.76 | 3.96 |
| 105 | 0.75 | 0.55 | 0.63 | 1.93 | 3.96 |

Note)
The molecular weight of EXM-2 is calculated based on n = 2 and m, m' = 1.

Each of the samples 101 to 105 was loaded into single-use camera "Super Slim Ace" manufactured by Fuji Photo Film Co., Ltd. and allowed to stand still at room temperature indoors for one year. Thereafter, 50-scene test photographing was performed outdoors (fine weather, cloudy weather and skiing ground) and indoors, and the following development was carried out. Printing was performed by the use of printer PP1250 manufactured by Fuji Photo Film Co., Ltd., and finished print quality was estimated into five grades A, B, C, D and E. Each printing was effected under such conditions that the optimum finishing could be attained. At that time, the average exposure time consumed per-print in the 50-scene printing was determined.

Development was performed as follows by using the FP-360B automatic processor manufactured by Fuji Photo Film Co., Ltd. Note that the FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992, the disclosure of which is incorporated herein by reference.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide light-sensitive material (equivalent to one 24 Ex. 1)

The stabilizer and fixer were returned from (2) to (1) by counterflow, and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide light-sensitive material. Note also that each crossover time was 6 sec, and this time was included in the processing time of each preceding step.

The aperture areas of the processor were 100 cm² for the color developer, 120 cm² for the bleaching solution, and about 100 cm² for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixing (1) Tank Solution)

A 5:95 (volume ratio) mixture of the above bleaching tank solution and the following fixing tank solution (pH 6.8).

| (Fixing (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononylphenylether (average polymerization degree 10) | 0.2 |
| 1,2-benzolsothiazoline-3-one sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

TABLE 5

| Sample No. | Remark | Drying time (second) | Amount of developer carried over to bleaching step (ml) | Print evaluation | Average printer exposure time consumed per print (relative value) |
|---|---|---|---|---|---|
| 101 | Comp. | 70 | 2.5 | C | 14 |
| 102 | Inv. | 30 | 1.5 | B | 5 |
| 103 | Inv. | 30 | 1.7 | B | 6 |
| 104 | Inv. | 30 | 1.5 | B | 4 |
| 105 | Inv. | 40 | 1.9 | B | 7 |

A 35 mm wide and 1.1 m long piece was cut out from each of the above samples 101 to 105, exposed to incandescent lamps, and subjected to the above development processing. Provided, however, that in the final drying step the drying time was varied from 30 sec to 1 min 30 sec, and that immediately after the completion of drying step the samples were placed in a closed vessel wherein the weight thereof was measured. The shortest time (t) satisfying the relationship $(w(t-10)-w(t))/w(0) \leqq 0.04$, wherein w(t) (g) (herein, t represented drying time (sec)) represented the weight at the measurement while w(0) represented the weight immediately before the drying step, was defined as the drying completion time.

A 35 mm wide and 1.1 m long piece was cut out from each of the above samples 101 to 105, exposed to incandescent lamps, and subjected to the above development processing. At that time, the amount of developer carry-over to the bleaching step was measured. The amount of developer carry-over was determined by first measuring the weight of lightsensitive material before passage through the developer, taking out the lightsensitive material after passage through the developer, measuring the weight thereof, calculating the weight difference and dividing the difference by the specific gravity.

As apparent from Table 5, as a result of photographing with the use of the samples of the present invention, excellent prints were obtained even through over-exposure, and even then, extreme prolongation of the exposure time at printing leading to lowering of print productivity was avoided. Moreover, as specified in Table 5, the shortening of drying time at development processing and the reduction of developer carry-over to the subsequent step were observed at the processing of the samples of the present invention. Comparison between sample 103 and sample 105 suggested that the shortening of drying time and the reduction of developer carry-over to the subsequent step were conspicuous when the coating amount of yellow dye forming coupler was not greater than 0.9 mmol/$m^2$, the coating amount of magenta dye forming coupler not greater than 0.4 mmol/$m^2$, and the coating amount of cyan dye forming coupler not greater than 0.7 mmol/$m^2$.

EXAMPLE 2

Each of the samples 101 to 105 was applied to a support of triacetylcellulose film, and wrought into the 135 format, thereby obtaining samples 201 to 205. Each of these samples was allowed to stand still at room temperature indoors for one year, loaded into a compact zoom camera (focal distance: 38 to 115 mm, and F value: 4.5/9.7), and subjected to the same test as in Example 1. The test showed the same excellent results of color negative lightsensitive materials according to the present invention as in Example 1. The above samples 201 to 205 can have previously exposed bar code information for specifying each film. Optimum printing conditions can be stored in advance in a printer by reading the information in the printer, so that the productivity for obtaining optimum prints has strikingly been enhanced.

EXAMPLE 3-1

The same effect as in Example 2 was attained even when EEC-1 was substituted for ExC-1, 3, 4 in the molar quantity equal to the total molar quantity of ExC-1, 3, 4. Also, the same effect as in Example 2 was attained even when EEM-1 was substituted for EXM-2, 4 in the molar quantity equal to the total molar quantity of EXM-2, 4. Further, the same effect as in Example 2 was attained even when EEY-1 was substituted for ExY-2 in the equal molar quantity.

EEC-1

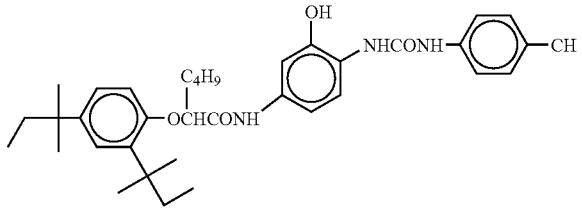

EEM-1

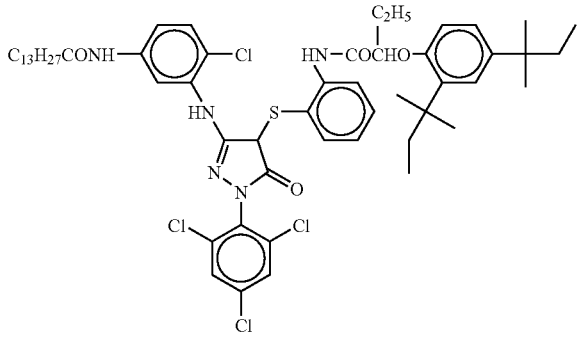

EEY-1

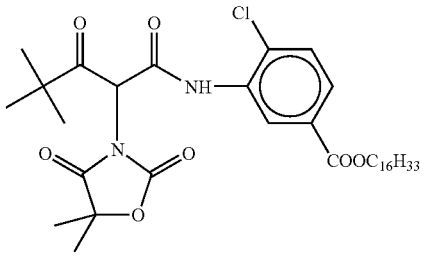

EXAMPLE 3-2

The same effect as in Example 2 was attained even when EKC-1 was substituted for ExC-1, 3, 4 in the molar quantity equal to the total molar quantity of ExC-1, 3, 4. Also, the same effect as in Example 2 was attained even when EKM-1 was substituted for EXM-2, 4 in the molar quantity equal to the total molar quantity of EXM-2, 4. Further, the same effect as in Example 2 was attained even when EKY-1 was substituted for ExY-2 in the equal molar quantity.

EKC-1

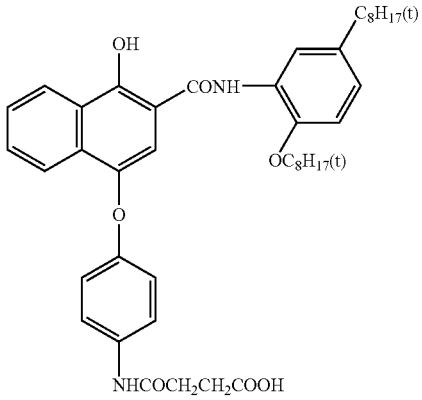

EKM-1

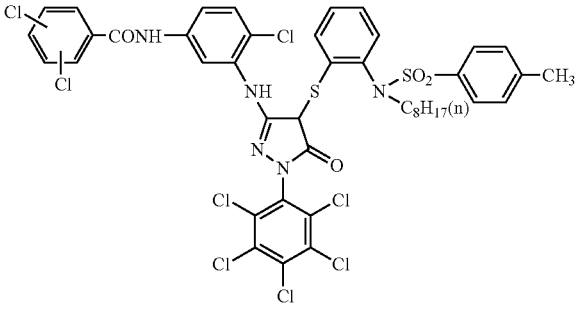

EKY-1

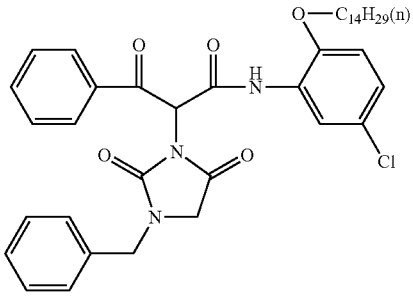

EXAMPLE 4

Each of the samples obtained in Example 2 was printed by the use of a digital printer. Each finished print quality was estimated into five grades A (excellent), B (rather excellent), C (fair), D (rather poor) and E (poor). Each printing was performed under such conditions that the optimum finishing could be attained. At that time, the average scanner read-in time per scene in 50-scene printing was measured.

TABLE 6

| Sample No. | Remark | Print evaluation | Average scanner read-in time per scene (relative value) |
|---|---|---|---|
| 101 | Comp. | C | 16 |
| 102 | Inv. | A | 7 |
| 103 | Inv. | A | 8 |
| 104 | Inv. | A | 5 |
| 105 | Inv. | A | 9 |

The print quality of this invention was superior to that of the Comparative Example, as demonstrated in Example 2. The print quality difference was greater in the digital printing than in the surface exposure printing (results of Example 2). Further, as apparent from Table 6, the samples of the present invention realized shortening of scanner reading time, thereby enhancing the print productivity at digital printer processing.

The following processings were performed at printing by means of the digital printer:

1. storing in advance the characteristic curves and color processing coefficients of lightsensitive materials of the present invention and Superia 400 as standard lightsensitive material in an image processor;

2. at the time of processing each lightsensitive material of the present invention, causing the image processor to recognize the same being among the lightsensitive materials of the present invention by the bar code thereof;

3. after the reading by the scanner, performing not only gradation processing for conversion to the gradation of Superia 400 but also 3×3 or 3×10 color conversion processing;

4. performing image processings, for example, setup such as color correction or density correction, processing for inhibition of graininess such as hypersharpness, autododging processing such as hypertone processing, etc.; and 5. performing color space conversion for outputting to a printer capable of conducting laser exposure to a color paper with the use of a three-dimensional table, and carrying out printing.

The present invention has enabled obtaining the color negative lightsensitive material by which excellent prints can be obtained over a large exposure range with high print productivity even with the use of a compact camera or a single-use camera. Furthermore, the present invention has enabled shortening the time to finish, reducing maintenance workload through reduction of the replenishment rate with respect to processing solutions, and reducing the volume of waste solutions.

The invention claimed is:

1. A silver halide color photographic lightsensitive material comprising a support and, superimposed thereon, a blue-sensitive layer unit, a green-sensitive layer unit and a red-sensitive layer unit, each of these layers comprising at least two silver halide emulsion layers with different photographic speeds, together with at least one antihalation layer, wherein couplers capable of color formation are contained in a total coating amount of 0.02 mmol/$m^2$ to 2 mmol/$m^2$, silver is contained in a total 0.05 g/$m^2$ to 5.0 g/$m^2$ and the silver halide color photographic lightsensitive material has an ISO speed of 320 or greater.

2. The silver halide color photographic lightsensitive material according to claim 1, wherein a yellow dye forming coupler is contained in a coating amount of 0.009 mmol/$m^2$ to 0.9 mmol/$m^2$, a magenta dye forming coupler in a coating amount of 0.004 mmol/$m^2$ to 0.4 mmol/$m^2$ and a cyan dye forming coupler in a coating amount of 0.007 mmol/$m^2$ to 0.7 mmol/m.

3. The silver halide color photographic lightsensitive material according to claim 1, wherein at least one coupler represented by the general formula (I) or the general formula (II) is contained;

Formula (I)

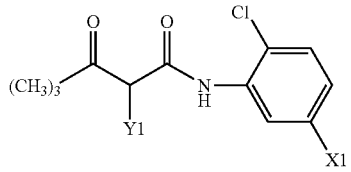

wherein X1 represents a —$CO_2C_{16}H_{33}$, a —$CO_2CH(C_4H_9)CO_2C_{12}H_{25}$ or a —$NHSO_2C_{16}H_{33}$; and Y1 represents a 5,5-dimethyloxazolidine-2,4-dion-3-yl group, a 1-benzyl-2-phenyltriazolidine-3,5-dion-4-yl group or a 4-(4-hydroxyphenylsulfonyl)phenoxy group;

Formula (II)

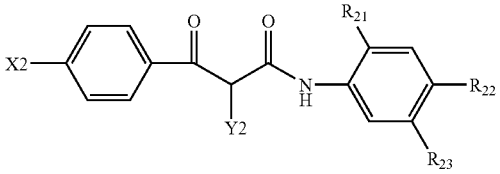

wherein X2 represents a hydrogen atom, a methoxy group or a —$OC_{16}H_{33}$; $R_{21}$ represents a chlorine atom, a methoxy group or a —$OC_{14}H_{29}$; $R_{22}$ represents a hydrogen atom or a —$SO_2N(CH_3)_2$; $R_{23}$ represents a hydrogen atom, a chlorine atom, a —$CO_2CH(CH_3)CO_2C_{12}H_{25}$ or a —$CO_2C_{12}H_{25}$; and Y2 represents a 1-benzylimidazoline-2,4-dion-3-yl group or a 2-(N-phenylcarbamoyl)imidazol-1-yl group.

4. The silver halide color photographic lightsensitive material according to claim 2, wherein at least one coupler represented by the general formula (I) or the general formula (II) is contained;

Formula (I)

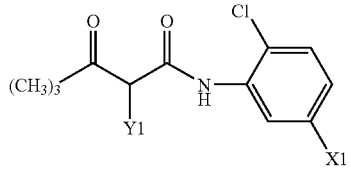

wherein X1 represents a —$CO_2C_{16}H_{33}$, a —$CO_2CH(C_4H_9)CO_2C_{12}H_{25}$ or a —$NHSO_2C_{16}H_{33}$; and Y1 represents a 5,5-dimethyloxazolidine-2,4-dion-3-yl group, a 1-benzyl-2-phenyltriazolidine-3,5-dion-4-yl group or a 4-(4-hydroxyphenylsulfonyl)phenoxy group;

Formula (II)

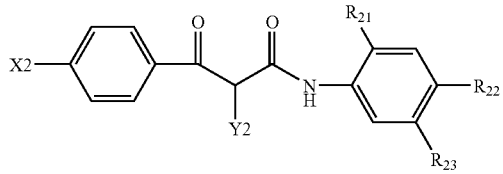

wherein X2 represents a hydrogen atom, a methoxy group or a —$OC_{16}H_{33}$; $R_{21}$ represents a chlorine atom, a methoxy group or a —$OC_{14}H_{29}$; $R_{22}$ represents a hydrogen atom or a —$SO_2N(CH_3)_2$; $R_{23}$ represents a hydrogen atom, a chlorine atom, a —$CO_2CH(CH_3)CO_2C_{12}H_{25}$ or a —$CO_2C_{12}H_{25}$; and Y2 represents a 1-benzylimidazoline-2,4-dion-3-yl group or a 2-(N-phenylcarbamoyl)imidazol-1-yl group.

5. The silver halide color photographic lightsensitive material according to claim 1, wherein a coupler represented by the general formula (III) is contained;

Formula (III)

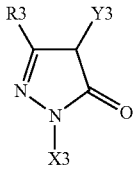

wherein X3 represents a 2,4,6-trichlorophenyl group, a 2,3,4,5,6-pentachlorophenyl group or a 2,5-dichlorophenyl group; R3 represents a group selected from among the following groups:

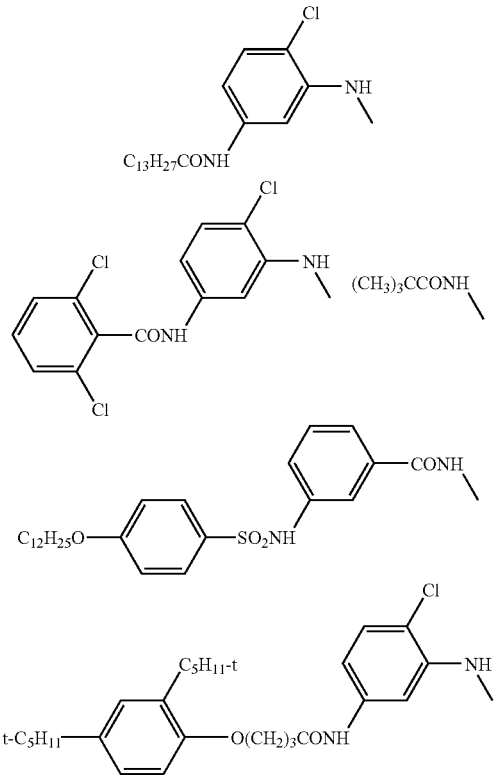

and Y3 represents a hydrogen atom or a group selected from among the following groups:

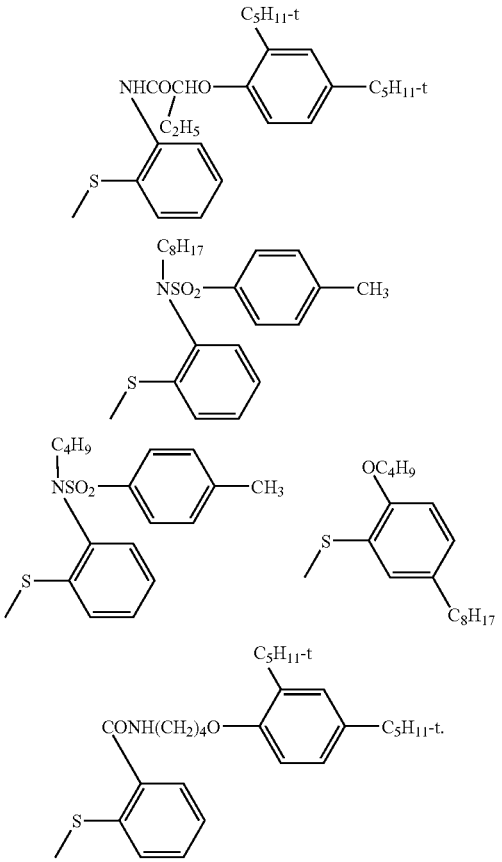

6. The silver halide color photographic lightsensitive material according to claim 2, wherein a coupler represented by the general formula (III) is contained;

Formula (III)

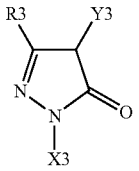

wherein X3 represents a 2,4,6-trichlorophenyl group, a 2,3,4,5,6-pentachlorophenyl group or a 2,5-dichlorophenyl group; R3 represents a group selected from among the following groups:

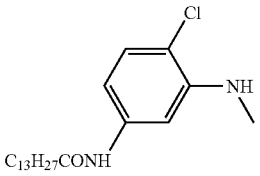

-continued

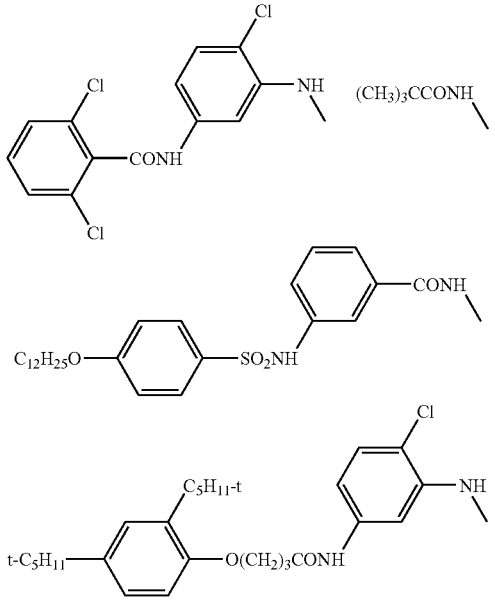

and Y3 represents a hydrogen atom or a group selected from among the following groups:

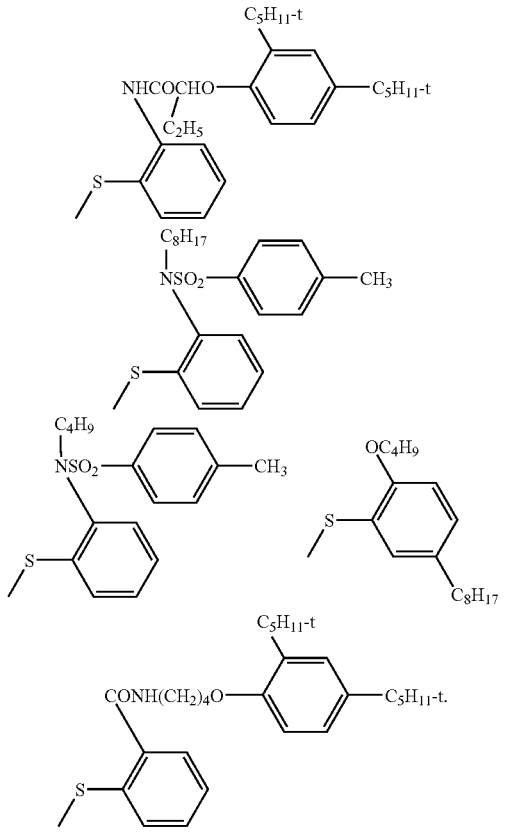

7. The silver halide color photographic lightsensitive material according to claim 1, wherein at least one coupler represented by the general formula (IV) or the general formula (V) is contained;

Formula (IV)

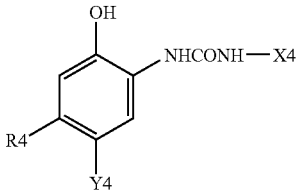

wherein X4 represents a 4-cyanophenyl group, a 3,4-dicyanophenyl group, a 4-chloro-3-cyanophenyl group, a 3-chloro-4-cyanophenyl group or a 4-fluorophenyl group; Y4 represents a hydrogen atom, a 4-methoxyphenoxy group or a methoxycarbonylmethoxy group; and R4 represents a group selected from among the following groups:

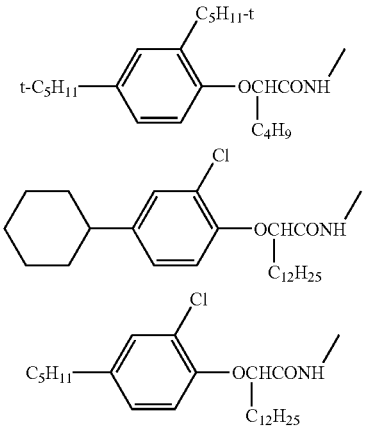

Formula (V)

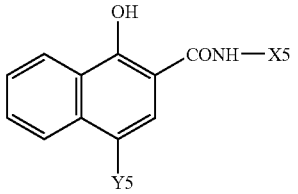

wherein X5 represents a 2-octyloxy-5-octylphenyl group, a 4-(2,4-di-t-amylphenoxy)butyl group or a 2-methyl-5-undecylcarbonylphenyl group; and Y5 represents a chlorine atom or a group selected from among the following groups:

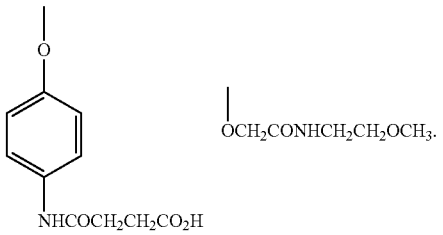

8. The silver halide color photographic lightsensitive material according to claim 2, wherein at least one coupler represented by the general formula (IV) or the general formula (V) is contained;

Formula (IV)

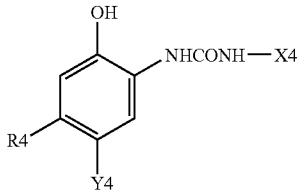

wherein X4 represents a 4-cyanophenyl group, a 3,4-dicyanophenyl group, a 4-chloro-3-cyanophenyl group, a 3-chloro-4-cyanophenyl group or a 4-fluorophenyl group; Y4 represents a hydrogen atom, a 4-methoxyphenoxy group or a methoxycarbonylmethoxy group; and R4 represents a group selected from among the following groups:

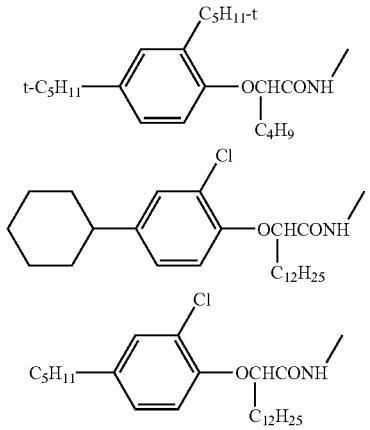

Formula (V)

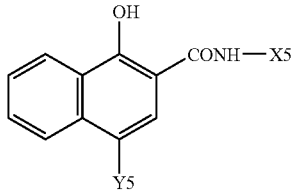

wherein X5 represents a 2-octyloxy-5-octylphenyl group, a 4-(2,4-di-t-amylphenoxy)butyl group or a 2-methyl-5-undecylcarbonylphenyl group; and Y5 represents a chlorine atom or a group selected from among the following groups:

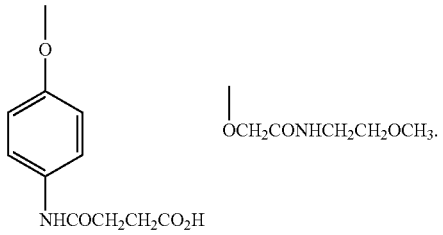

Formula (IV)

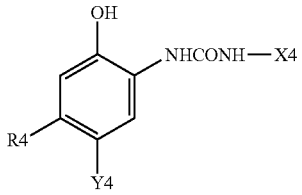

wherein X4 represents a 4-cyanophenyl group, a 3,4-dicyanophenyl group, a 4-chloro-3-cyanophenyl group, a 3-chloro-4-cyanophenyl group or a 4-fluorophenyl group; Y4 represents a hydrogen atom, a 4-methoxyphenoxy group or a methoxycarbonylmethoxy group; and R4 represents a group selected from among the following groups:

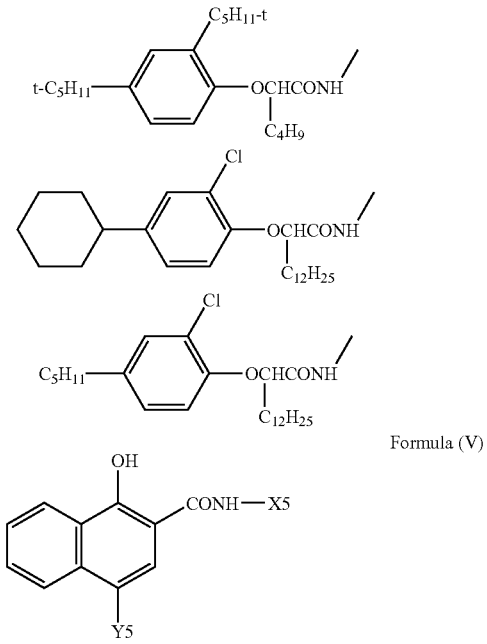

Formula (V)

wherein X5 represents a 2-octyloxy-5-octylphenyl group, a 4-(2,4-di-t-amylphenoxy)butyl group or a 2-methyl-5-undecylcarbonylphenyl group; and Y5 represents a chlorine atom or a group selected from among the following groups:

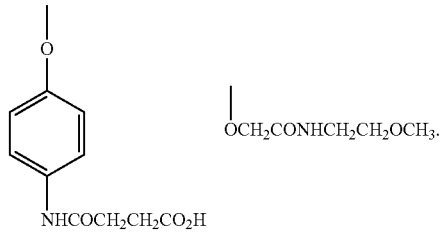

9. A package of silver halide color photographic lightsensitive material, comprising a light-shielding container and, accommodated in rolled form therein, a silver halide color photographic lightsensitive material according to claim 1.

10. The package of silver halide color photographic lightsensitive material according to claim 9, wherein the silver halide color photographic lightsensitive material is one exposed in advance so as to have information relating thereto.

11. The package of silver halide color photographic lightsensitive material according to claim 10, wherein the information relating to the silver halide color photographic lightsensitive material accommodated in the package of silver halide color photographic lightsensitive material is provided in electrically or optically readable form.

12. A lens-equipped film unit comprising photographing means including a camera lens, a shutter equipment of fixed speed, a diaphragm and an electronic flash equipment, the lens-equipped film unit loaded in advance with an unexposed photographic film, wherein the photographic film is provided by the package of silver halide color photographic lightsensitive material according to claim 9.

13. A lens-equipped film unit comprising photographing means including a camera lens, a shutter equipment of fixed speed, a diaphragm and an electronic flash equipment, the lens-equipped film unit loaded in advance with an unexposed photographic film, wherein the photographic film is provided by the package of silver halide color photographic lightsensitive material according to claim 10.

14. A method of forming an image, comprising, by means of a scanner capable of converting an image information to an electrical signal in at least three wavelength regions, converting an image information of the silver halide color photographic lightsensitive material according to claim 1 to a digital color image signal and carrying out gradation conversion and color conversion processings suitable for the photographic lightsensitive material, thereby outputting an RGB image constituted of red image signal (R), green image signal (G) and blue image signal (B).

15. A method of forming an image, comprising, by means of a scanner capable of converting an image information to an electrical signal in at least three wavelength regions, converting an image information of the silver halide color photographic lightsensitive material according to claim 2 to a digital color image signal and carrying out gradation conversion and color conversion processings suitable for the photographic lightsensitive material, thereby outputting an RGB image constituted of red image signal (R), green image signal (G) and blue image signal (B).

* * * * *